US009624729B2

(12) United States Patent
Sullivan et al.

(10) Patent No.: US 9,624,729 B2
(45) Date of Patent: Apr. 18, 2017

(54) REAL TIME BIT MONITORING

(75) Inventors: Eric Sullivan, Houston, TX (US); Terry Hunt, Mt. Pearl (CA); Sorin Teodorescu, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 783 days.

(21) Appl. No.: 13/237,754

(22) Filed: Sep. 20, 2011

(65) Prior Publication Data

US 2012/0152617 A1 Jun. 21, 2012

Related U.S. Application Data

(63) Continuation-in-part of application No. 12/332,107, filed on Dec. 10, 2008, now abandoned.

(51) Int. Cl.

| | |
|---|---|
| ***E21B 12/02*** | (2006.01) |
| ***E21B 10/42*** | (2006.01) |
| ***E21B 10/00*** | (2006.01) |

(52) U.S. Cl.

CPC ..... *E21B 10/00* (2013.01); *E21B 12/02* (2013.01); *Y10T 29/49764* (2015.01)

(58) Field of Classification Search

CPC ..... E21B 12/02
USPC ..... 175/39, 40, 50
See application file for complete search history.

(56) References Cited

U.S. PATENT DOCUMENTS

| | | | | |
|---|---|---|---|---|
| 3,079,821 A | | 3/1963 | Hansjorg Renker et al. | |
| 4,655,300 A | | 4/1987 | Davis, Jr. et al. | |
| 4,694,686 A | | 9/1987 | Fildes et al. | |
| 4,785,894 A | | 11/1988 | Davis, Jr. et al. | |
| 4,785,895 A | | 11/1988 | Davis, Jr. et al. | |
| 4,786,220 A | | 11/1988 | Fildes et al. | |
| 4,928,521 A | | 5/1990 | Jardine | |
| 4,943,488 A | | 7/1990 | Sung et al. | |
| 5,049,164 A | | 9/1991 | Horton et al. | |
| 5,216,917 A | | 6/1993 | Detournay | |
| 5,443,565 A | * | 8/1995 | Strange, Jr. | 175/431 |
| 5,582,261 A | | 12/1996 | Keith et al. | |

(Continued)

FOREIGN PATENT DOCUMENTS

| | | |
|---|---|---|
| JP | 03-259702 | 11/1991 |
| JP | 03-259707 | 11/1991 |
| JP | 2008-223311 | 9/2008 |

OTHER PUBLICATIONS

Aliko, E., Hunt, T., George, M., and Nicol, J., "New-Generation PDC Bits Allow Drilling at Record Rates of Penetration and Increased Durability in Challenging Algerian Applications," Abstract, IADC/SPE 112733, IADC/SPE Drilling Conference, Mar. 4-6, 2008, Orlando, Florida.

(Continued)

*Primary Examiner* — David Andrews
(74) *Attorney, Agent, or Firm* — Cantor Colburn LLP

(57) ABSTRACT

A bit is assembled by forming the bit, including a bit body and a plurality of cutting components; embedding at least one electrical circuit into the bit, the circuit including a temperature sensor; and providing a module to monitor the circuits and generate an indication of bit wear. The electrical circuit may experience a change in resistance or conductivity due to wear of the bit and/or changes in an earth formation adjacent the bit. The bit wear and/or formation changes may be displayed for an operator.

16 Claims, 15 Drawing Sheets

(56) References Cited

U.S. PATENT DOCUMENTS

| | | | | |
|---|---|---|---|---|
| 6,167,833 | B1 | 1/2001 | Caraway et al. | |
| 6,206,108 | B1 * | 3/2001 | MacDonald et al. | 175/24 |
| 6,401,844 | B1 | 6/2002 | Doster et al. | |
| 6,631,772 | B2 | 10/2003 | Palaschenko | |
| 6,634,441 | B2 | 10/2003 | Palaschenko | |
| 6,843,333 | B2 | 1/2005 | Richert et al. | |
| 7,048,081 | B2 | 5/2006 | Smith et al. | |
| 2005/0154568 | A1 | 7/2005 | Huang | |
| 2008/0060848 | A1 | 3/2008 | Pastusek et al. | |

OTHER PUBLICATIONS

Lee, S.G., International Search Report for International Patent Application No. PCT/US2009/067450, Korean Intellectual Property Office, dated May 14, 2010.

Lee, S.G., Written Opinion for International Patent Application No. PCT/US2009/067450, Korean Intellectual Property Office, dated May 14, 2010.

Se Gyoung Lee, International Search Report for International Patent Application No. PCT/US2009/067450, Korean Intellectual Property Office, Republic of Korea, dated May 14, 2010.

Se Gyoung Lee, Written Opinion for International Patent Application No. PCT/US2009/067450, Korean Intellectual Property Office, Republic of Korea, dated May 14, 2010.

Aliko, E., Hunt, T., George, M., and Nicol, J. "New-Generation PDC Bits Allow Drilling at Record Rates of Penetration and Increased Durability in Challenging Algerian Applications." IADC/SPE 112733, IADC/SPE Drilling Conference, Mar. 4-6, 2008, Orlando, Florida.

* cited by examiner

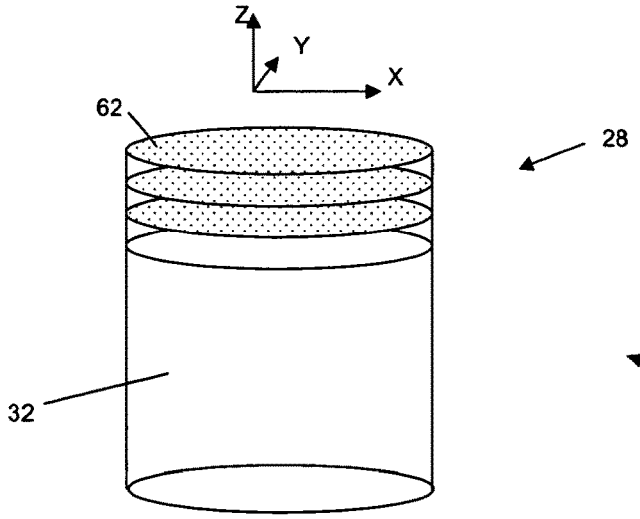
FIG. 14
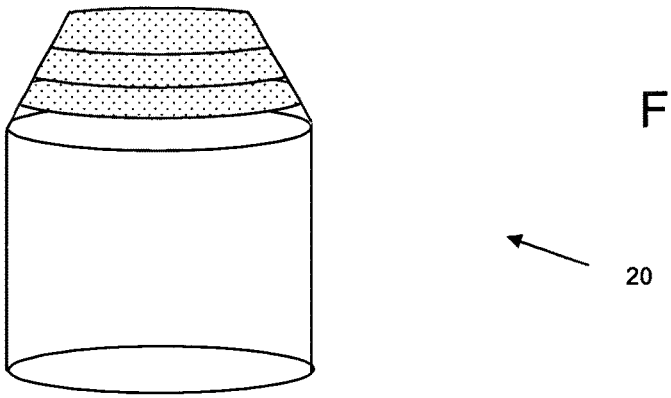
FIG. 15
FIG. 16
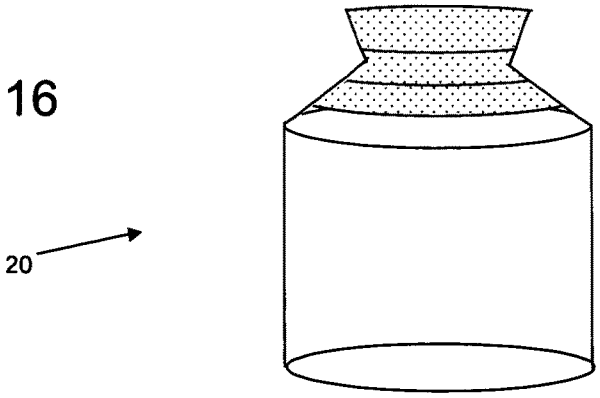

REAL TIME BIT MONITORING

CROSS REFERENCE TO RELATED APPLICATIONS

This application contains similar subject matter as that disclosed in U.S. patent application Ser. No. 12/327,925 entitled, "Method of Monitoring Wear of Rock Bit Cutters", filed on Dec. 4, 2008. This application is a continuation-in-part of U.S. patent application Ser. No. 12/332,107 entitled, "Method And System for Detecting Drill Bit Wear", filed on Dec. 10, 2008. Both of these applications are incorporated herein by specific reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to drill bits for drilling wells; and more specifically relate to monitoring the wear of drill bits for drilling wells in earth formations.

Description of the Related Art

U.S. Pat. No. 4,655,300 teaches "a method and apparatus for detecting excessive wear of a rotatable bit used in drilling. In particular, the apparatus can detect loss of gauge or bearing failure in a bit. The method is accomplished by connecting a restricting means in the drill bit that can be manipulated to reduce the flow of drilling fluid through at least one port in the drill bit. A wire is connected between a sensor which senses wear and the restriction means to cause the restriction means to reduce the flow of drilling fluid and thereby signal the surface by the reduced flow as an indication of wear."

U.S. Pat. No. 4,694,686 teaches a "method and apparatus by which the degree of wear and useful life limitations of a drill, end mill or other types of metal removal tools can be detected. The method is based on the short circuit current, open circuit voltage and/or power that is generated during metal removal by the utilization of an insulated rotary tool bit to which electrical contact is made by a non-rotating conductor and an insulated or non-insulated workpiece, with an external circuit connecting the tool and workpiece through a measuring device. The generated current, voltage or power shows a sharp increase or change in slope upon considerable tool wear and/or at the point of failure."

U.S. Pat. No. 4,785,894 teaches an "earth drilling bit incorporating a bit wear indicator. The bit wear indicator includes: a sensor to detect wear at a selected point on the bit; a device for altering the resistance of the bit to receiving drilling fluid from the drill string; and, a tensioned linkage extending between the wear sensor and the flow resistance altering means. On detecting a predetermined degree of wear, the wear sensor releases the tension in the tensioned linkage. This activates the flow resistance altering device, causing the flow rate and/or pumping pressure of the drilling fluid to change. This serves as a signal that the predetermined wear condition has been achieved. The bit wear indicator can be adapted to monitor many different types of bit wear, including bearing wear in roller-cone type bits and gauge wear in all types of bits."

U.S. Pat. No. 4,785,895 teaches an "earth drilling bit incorporating a tensioned linkage type bit wear indicator. A tensioned linkage extends through the bit between a wear sensor and a device for altering the resistance of the bit to receiving drilling fluid from the drill string. On detecting a predetermined degree of wear, the wear sensor releases the tension in the tensioned linkage. This activates the flow resistance altering device, causing the flow rate and/or pumping pressure of the drilling fluid to change. The tensioned linkage passes through two intersecting passageways in the bit. A guide element is inserted at the intersection of the two intersecting passageways. The guide element routes the tensioned linkage between the two passageways."

U.S. Pat. No. 4,786,220 teaches a "method and apparatus by which the degree of wear and useful life limitations of a drill, end mill or other types of metal removal tools can be detected. The method is based on the short circuit current, open circuit voltage and/or power that is generated during metal removal by the utilization of an insulated rotary tool bit to which electrical contact is made by a non-rotating conductor and an insulated or non-insulated workpiece, with an external circuit connecting the tool and workpiece through a measuring device. The generated current, voltage or power shows a sharp increase or change in slope upon considerable tool wear and/or at the point of failure."

U.S. Pat. No. 4,928,521 teaches a "method is provided for determining the state of wear of a multicone drill bit. Vibrations generated by the working drill bit are detected and converted into a time oscillatory signal from which a frequency spectrum is derived. The periodicity of the frequency spectrum is extracted. The rate of rotation of at least one cone is determined from the periodicity and the state of wear of the drill bit is derived from the rate of cone rotation. The oscillatory signal represents the variation in amplitude of the vertical or torsional force applied to the drill bit. To extract periodicity, a set of harmonics in the frequency spectrum is given prominence by computing the cepstrum of the frequency spectrum or by obtaining an harmonic-enhanced spectrum. The fundamental frequency in the set of harmonics is determined and the rate of cone rotation is derived from the fundamental frequency."

U.S. Pat. No. 5,216,917 teaches "a new model describing the drilling process of a drag bit and concerns a method of determining the drilling conditions associated with the drilling of a borehole through subterranean formations, each one corresponding to a particular lithology, the borehole being drilled with a rotary drag bit, the method comprising the steps of: measuring the weight W applied on the bit, the bit torque T, the angular rotation speed $\Omega$ of the bit and the rate of penetration N of the bit to obtain sets of data ($W_i$, $T_i$, $N_i$, $\Omega_i$) corresponding to different depths; calculating the specific energy $E_i$ and the drilling strength $S_i$ from the data ($W_i$, $T_i$, $N_i$, $\Omega_i$); identifying at least one linear cluster of values ($E_i$, $S_i$), said cluster corresponding to a particular lithology; and determining the drilling conditions from said linear cluster. The slope of the linear cluster is determined, from which the internal friction angle $\phi$ of the formation is estimated. The intrinsic specific energy E of the formation and the drilling efficiency are also determined. Change of lithology, wear of the bit and bit balling can be detected."

U.S. Pat. No. 6,631,772 teaches a "system and method for detecting the wear of a roller bit bearing between a roller drill bit body and a roller bit rotatably attached to the roller drill bit body. A valve-plug is placed between the roller drill bit body and roller bit such that the valve-plug is removably fitted in a drilling fluid outlet in the roller drill bit body, and the valve-plug extends into a channel in the roller bit whereby uneven rotation or vibration of the roller bit causes the valve-plug to impact the sides of the channel which removes the valve-plug from the drilling fluid outlet to cause drilling fluid to flow through the drilling fluid outlet. The drop in pressure from the drilling fluid flowing through the drilling fluid outlet indicates that the roller bit is worn and may fail."

U.S. Pat. No. 6,634,441 teaches a "system and method for detecting the wear of a roller bit bearing on a roller drill bit body where the roller element has a plurality of cutting elements and is rotatably attached to the roller drill bit body at the bearing. In the invention, a rotation impeder is in between the roller element and roller drill bit body and upon uneven rotation of the roller element which indicates that the roller element bearing may fail, the rotation impeder impedes the rotation of the roller element. The drill rig operator at the surface can cease drilling operations upon detection of the cessation of rotation of the roller element. The rotation impeder can also be seated in a drilling fluid outlet and cause a detectable loss in drilling fluid pressure when dislodged to otherwise cease rotation of the roller drill bit."

The inventions disclosed and taught herein are directed to an improved method of monitoring the wear of drill bits for drilling wells in earth formations.

BRIEF SUMMARY OF THE INVENTION

The invention relates to a method of monitoring the wear of drill bits for drilling wells in earth formations, several embodiments of an improved drill bit for drilling a well in an earth formation, and methods of manufacture. In one embodiment, the bit is assembled by forming the bit, including a bit body and a plurality of cutting components; embedding one or more electrical circuits into the bit; and providing a module to monitor the circuits and generate an indication of bit wear and/or formation changes. The electrical circuit that may experience a change in resistance or conductivity due to wear of the bit and/or formation changes. The bit wear and/or formation changes may be displayed for an operator.

A drill bit assembly, according to the present invention, may comprise a drill bit including a bit body and a plurality of cutting components; one or more electrical circuits within the drill bit; and a module to monitor the electrical circuits and generate an indication of bit wear and/or formation changes. The electrical circuits that may experience a change in resistance or conductivity due to wear of the bit and/or formation changes. The bit wear and/or formation changes may be displayed for an operator on a surface computer.

BRIEF DESCRIPTION OF THE SEVERAL VIEWS OF THE DRAWINGS

FIG. 14 illustrates a perspective view of a cutter utilizing certain aspects of the present inventions;

FIG. 15 illustrates a perspective view of a cutter showing wear utilizing certain aspects of the present inventions;

FIG. 16 illustrates another perspective view of a cutter showing wear utilizing certain aspects of the present inventions;

DETAILED DESCRIPTION

Figure 1:
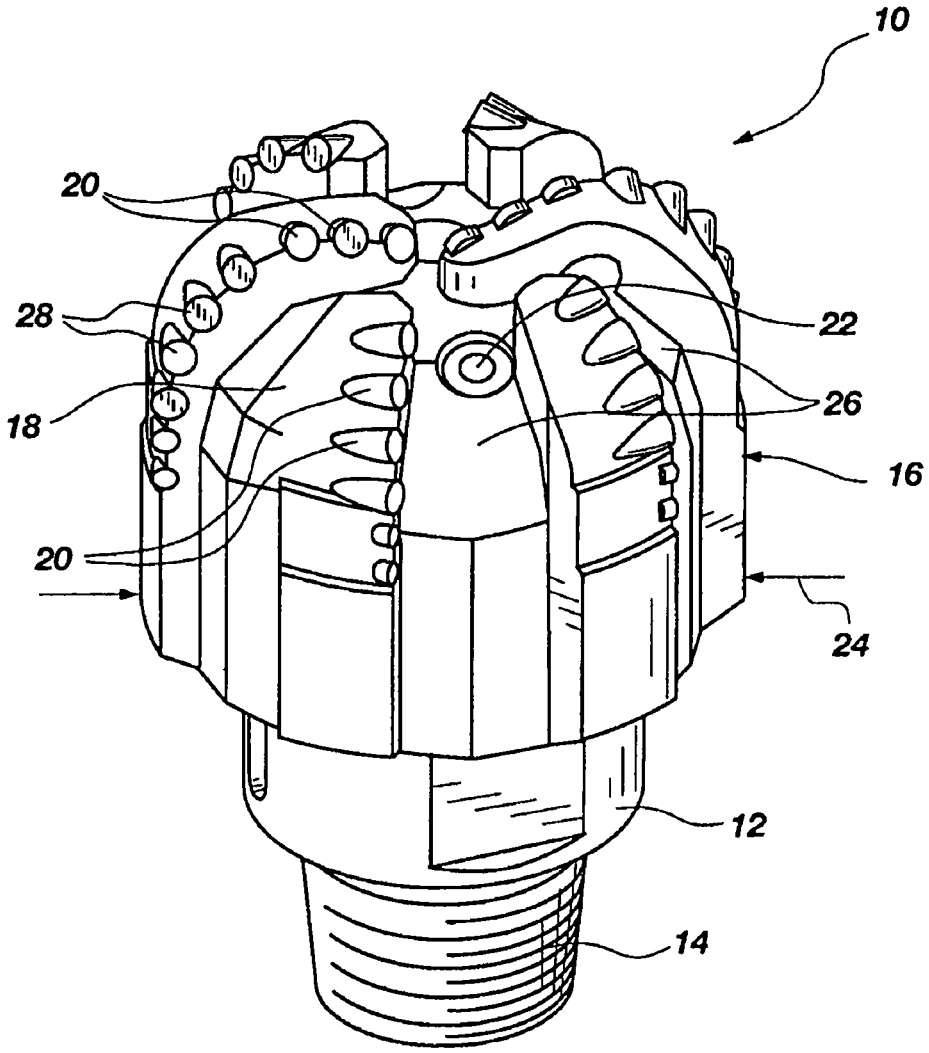
FIG. 1 illustrates a perspective view of an exemplary drill bit incorporating cutting elements and embodying certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Particular embodiments of the invention may be described below with reference to block diagrams and/or operational illustrations of methods. In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Applicants have created a method of monitoring the wear of drill bits for drilling wells in earth formations, several embodiments of an improved drill bit for drilling a well in an earth formation, and methods of manufacture. In one embodiment, the bit is assembled by forming the bit, including a bit body and a plurality of cutting components; embedding one or more electrical circuits into the bit; and providing a module to monitor the electrical circuits and generate an indication of bit wear and/or formation changes. The electrical circuits that may experience a change in resistance or conductivity due to wear of the bit and/or formation changes. The bit wear and/or formation changes may be displayed for an operator.

FIG. 1 is an illustration of a drill bit 10 that includes a bit body 12 having a conventional pin end 14 to provide a threaded connection to a conventional jointed tubular drill string rotationally and longitudinally driven by a drilling rig. Alternatively, the drill bit 10 may be connected in a manner known within the art to a bottomhole assembly which, in turn, is connected to a tubular drill string or to an essentially continuous coil of tubing. Such bottomhole assemblies may include a downhole motor to rotate the drill bit 10 in addition to, or in lieu of, being rotated by a rotary table or top drive located at the surface or on an offshore platform (not shown within the drawings). Furthermore, the conventional pin end 14 may optionally be replaced with various alternative connection structures known within the art. Thus, the drill bit 10 may readily be adapted to a wide variety of mechanisms and structures used for drilling subterranean formations.

The drill bit 10, and select components thereof, are preferably similar to those disclosed in U.S. Pat. No. 7,048,081, which is incorporated herein by specific reference. In any case, the drill bit 10 preferably includes a plurality of blades 16 each projecting outwardly from a face 18. The drill bit 10 also preferably includes a row of cutters, or cutting elements, 20 secured to the blades 16. The drill bit 10 also preferably includes a plurality of nozzles 22 to distribute drilling fluid to cool and lubricate the drill bit 10 and remove cuttings. As customary in the art, gage 24 is the maximum diameter which the drill bit 10 is to have about its periphery. The gage 24 will thus determine the minimum diameter of the resulting bore hole that the drill bit 10 will produce when placed into service. The gage 24 of a small drill bit may be as small as a few centimeters and the gage 24 of an extremely large drill bit may approach a meter, or more. Between each blade 16, the drill bit 10 preferably has fluid slots, or passages, 26 into with the drilling fluid is fed by the nozzles 22.

Figure 2:
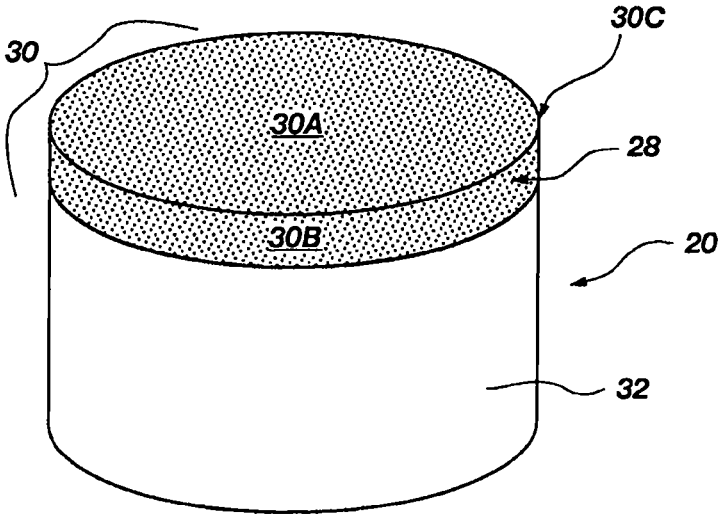
FIG. 2 is an enlarged perspective view of an exemplary cutting element embodying certain aspects of the present inventions.

An exemplary cutting element 20 of the present invention, as shown in FIG. 2, includes a super-abrasive cutting table 28 of circular, rectangular or other polygon, oval, truncated circular, triangular, or other suitable cross-section. The super-abrasive table 28, exhibiting a circular cross-section and an overall cylindrical configuration, or shape, is suitable for a wide variety of drill bits and drilling applications. The super-abrasive table 28 of the cutting element 20 is preferably formed with a conglomerated super-abrasive material, such as a polycrystalline diamond compact (PDC), with an exposed cutting face 30. The cutting face 30 will typically have a top 30A and a side 30B with the peripheral junction thereof serving as the cutting region of the cutting face 30 and more precisely a cutting edge 30C of the cutting face 30, which is usually the first portion of the cutting face 30 to contact and thus initially "cut" the formation as the drill bit 10 retaining the cutting element 20 progressively drills a bore hole. The cutting edge 30C may be a relatively sharp approximately ninety-degree edge, or may be beveled or rounded. The super-abrasive table 28 will also typically have a primary underside, or attachment, interface face joined during the sintering of the diamond, or super-abrasive, layer forming the super-abrasive table 28 to a supporting substrate 32 typically formed of a hard and relatively tough material such as a cemented tungsten carbide or other carbide. The substrate 32 may be pre-formed in a desired shape such that a volume of particulate diamond material may be formed into a polycrystalline cutting, or super-abrasive, table 28 thereon and simultaneously strongly bonded to the substrate 32 during high pressure high temperature (HPHT) sintering techniques practiced within the art. Such cutters are further described in U.S. Pat. No. 6,401,844, the disclosure of which is incorporated herein by specific reference in its entirety. A unitary cutting element 20 will thus be provided that may then be secured to the drill bit 10 by brazing or other techniques known within the art.

In accordance with the present invention, the super-abrasive table 28 preferably comprises a heterogeneous conglomerate type of PDC layer or diamond matrix in which at least two different nominal sizes and wear characteristics of super-abrasive particles, such as diamonds of differing grains, or sizes, are included to ultimately develop a rough, or rough cut, cutting face 30, particularly with respect to the cutting face side 30B and most particularly with respect to the cutting edge 30C. In one embodiment, larger diamonds may range upwards of approximately 600 μm, with a preferred range of approximately 100 μm to approximately 600 μm, and smaller diamonds, or super-abrasive particles, may preferably range from about 15 μm to about 100 μm. In another embodiment, larger diamonds may range upwards of approximately 500 μm, with a preferred range of approximately 100 μm to approximately 250 μm, and smaller diamonds, or super-abrasive particles, may preferably range from about 15 μm to about 40 μm.

The specific grit size of larger diamonds, the specific grit size of smaller diamonds, the thickness of the cutting face 30 of the super-abrasive table 28, the amount and type of sintering agent, as well as the respective large and small diamond volume fractions, may be adjusted to optimize the cutter 20 for cutting particular formations exhibiting particular hardness and particular abrasiveness characteristics. The relative, desirable particle size relationship of larger diamonds and smaller diamonds may be characterized as a tradeoff between strength and cutter aggressiveness. On the one hand, the desirability of the super-abrasive table 28 holding on to the larger particles during drilling would dictate a relatively smaller difference in average particle size between the smaller and larger diamonds. On the other hand, the desirability of providing a rough cutting surface would dictate a relatively larger difference in average particle size between the smaller and larger diamonds. Furthermore, the immediately preceding factors may be adjusted to optimize the cutter 20 for the average rotational speed at which the cutting element 20 will engage the formation as well as for the magnitude of normal force and torque to which each cutter 20 will be subjected while in service as a result of the rotational speeds and the amount of weight, or longitudinal force, likely to be placed on the drill bit 10 during drilling.

The blades 16 and or the bit body 12 may be made from an alloy matrix, such as a matrix of tungsten carbide powder impregnated with a copper alloy binder during a casting process. For example, the drill bit 10 may be constructed as a matrix style drill bit using an infiltration casting process whereby the copper alloy binder is heated past its melting temperature and allowed to flow, under the influence of gravity, into a matrix of carbide powder packed into, and shaped by, a graphite mold. The mold preferably contains the shapes of the blades 16 and slots 26 of the drill bit 10, creating a form for the drill bit 10. Other features may be made from clay and/or sand and attached to the mold.

Figure 3:
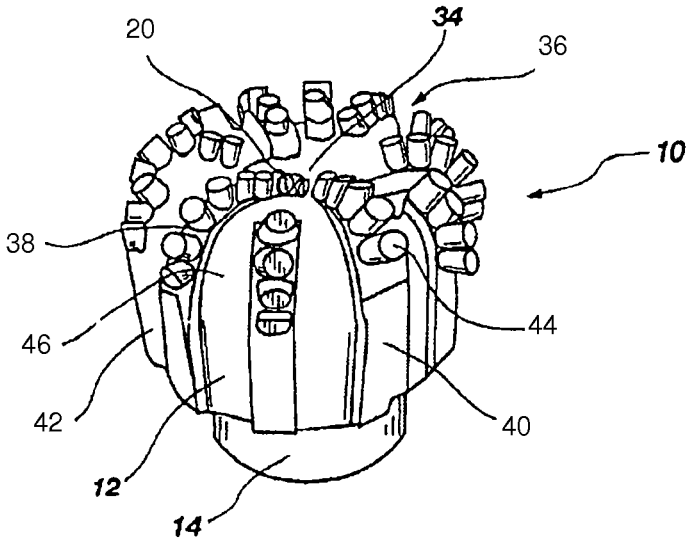
FIG. 3 illustrates a perspective view of an exemplary impregnated drill bit embodying certain aspects of the present inventions.

Alternatively, the bit 10 may be similar to those disclosed in U.S. Pat. No. 6,843,333, the disclosure of which is incorporated herein by specific reference in its entirety. Referring now to FIG. 3, the bit 10 is, in one embodiment, 8½" in diameter and includes a matrix-type bit body 12 having a shank 14 for connection to a drill string (not shown) extending therefrom opposite a bit face 36. A plurality of blades 38 extends generally radially outwardly in linear fashion to gage pads 40 defining junk slots 42 therebetween. The bit 10 may employ fluid passages 46 between blades 38 and extending to junk slots 42 to enhance fluid flow over the bit face 36.

The bit 10 may include conventional impregnated bit cutting structures and/or discrete, impregnated cutting structures 44 comprising posts extending upwardly from the blades 38 on the bit face 36. The cutting structures 44 may be formed as an integral part of the matrix-type blades 38 projecting from the matrix-type bit body 12 by hand-packing diamond grit-impregnated matrix material in mold cavities on the interior of a bit mold defining locations of the cutting structures 44 and blades 38. Thus, each blade 38 and associated cutting structure 44 may define a unitary structure. It is noted that the cutting structures 44 may be placed directly on the bit face 36, dispensing with the blades. It is also noted that, while discussed in terms of being integrally formed with the bit 10, the cutting structures 44 may be formed as discrete individual segments, such as by hot isostatic pressing, and subsequently brazed or furnaced onto the bit 10.

The discrete cutting structures 44 may be mutually separate from each other to promote drilling fluid flow therearound for enhanced cooling and clearing of formation material removed by the diamond grit. The discrete cutting structures 44 may be generally of a round or circular transverse cross-section at their substantially flat, outermost ends, but become more oval with decreasing distance from the face of the blades 38 and thus provide wider or more elongated (in the direction of bit rotation) bases for greater strength and durability. As the discrete cutting structures 44 wear, the exposed cross-section of the posts increases, providing progressively increasing contact area for the diamond grit with the formation material. As the cutting structures wear down, the bit 10 takes on the configuration of a heavier-set bit more adept at penetrating harder, more abrasive formations. Even if discrete cutting structures 44 wear completely away, the diamond-impregnated blades 38 will provide some cutting action, reducing the possibility of ring-out and having to pull the bit 10.

While the cutting structures 44 are illustrated as exhibiting posts of circular outer ends and oval shaped bases, other geometries are also contemplated. For example, the outermost ends of the cutting structures may be configured as ovals having a major diameter and a minor diameter. The base portion adjacent the blade 38 might also be oval, having a major and a minor diameter, wherein the base has a larger minor diameter than the outermost end of the cutting structure 44. As the cutting structure 44 wears towards the blade 38, the minor diameter increases, resulting in a larger surface area. Furthermore, the ends of the cutting structures 44 need not be flat, but may employ sloped geometries. In other words, the cutting structures 44 may change cross-sections at multiple intervals, and tip geometry may be separate from the general cross-section of the cutting structure. Other shapes or geometries may be configured similarly. It is also noted that the spacing between individual cutting structures 44, as well as the magnitude of the taper from the outermost ends to the blades 38, may be varied to change the overall aggressiveness of the bit 10 or to change the rate at which the bit is transformed from a light-set bit to a heavy-set bit during operation. It is further contemplated that one or more of such cutting structures 44 may be formed to have substantially constant cross-sections if so desired depending on the anticipated application of the bit 10.

Discrete cutting structures 44 may comprise a synthetic diamond grit, such as, for example, DSN-47 Synthetic diamond grit, commercially available from DeBeers of Shannon, Ireland, which has demonstrated toughness superior to natural diamond grit. The tungsten carbide matrix material with which the diamond grit is mixed to form discrete cutting structures 44 and supporting blades 38 may desirably include a fine grain carbide, such as, for example, DM2001 powder commercially available from Kennametal Inc., of Latrobe, Pa. Such a carbide powder, when infiltrated, provides increased exposure of the diamond grit particles in comparison to conventional matrix materials due to its relatively soft, abradable nature. The base of each blade 38 may desirably be formed of, for example, a more durable 121 matrix material, obtained from Firth MPD of Houston, Tex. Use of the more durable material in this region helps to prevent ring-out even if all of the discrete cutting structures 44 are abraded away and the majority of each blade 38 is worn.

It is noted, however, that alternative particulate abrasive materials may be suitably substituted for those discussed above. For example, the discrete cutting structures 44 may include natural diamond grit, or a combination of synthetic and natural diamond grit. Alternatively, the cutting structures may include synthetic diamond pins. Additionally, the particulate abrasive material may be coated with a single layer or multiple layers of a refractory material, as known in the art and disclosed in U.S. Pat. Nos. 4,943,488 and 5,049,164, the disclosures of each of which are hereby incorporated herein by reference in their entirety. Such refractory materials may include, for example, a refractory metal, a refractory metal carbide or a refractory metal oxide. In one embodiment, the coating may exhibit a thickness of approximately 1 to 10 microns. In another embodiment, the coating may exhibit a thickness of approximately 2 to 6 microns. In yet another embodiment, the coating may exhibit a thickness of less than 1 micron.

In one embodiment, one or more of the blades 38 carry cutting elements, such as PDC cutters 20, in conventional orientations, with cutting faces oriented generally facing the direction of bit rotation. In one embodiment, the cutters 20 are located within the cone portion 34 of the bit face 36. The cone portion 34 is the portion of the bit face 36 wherein the profile is defined as a generally cone-shaped section about the centerline of intended rotation of the drill bit 10. Alternatively, or additionally, the cutters 20 may be located across the blades 38 and elsewhere on the bit 10.

This cutter design provides enhanced abrasion resistance to the hard and/or abrasive formations typically drilled by impregnated bits, in combination with enhanced performance, or rate of penetration (ROP), in softer, nonabrasive formation layers interbedded with such hard formations. It is noted, however, that alternative cutter designs may be implemented. For example, the cutters 20 may be configured of various shapes, sizes, or materials as known by those of skill in the art. Also, other types of cutting elements may be formed within the cone portion 34 of, and elsewhere across, the bit 10 depending on the anticipated application of the bit 10. For example, the cutting elements 20 may include cutters formed of thermally stable diamond product (TSP), natural diamond material, or impregnated diamond.

Figure 4:
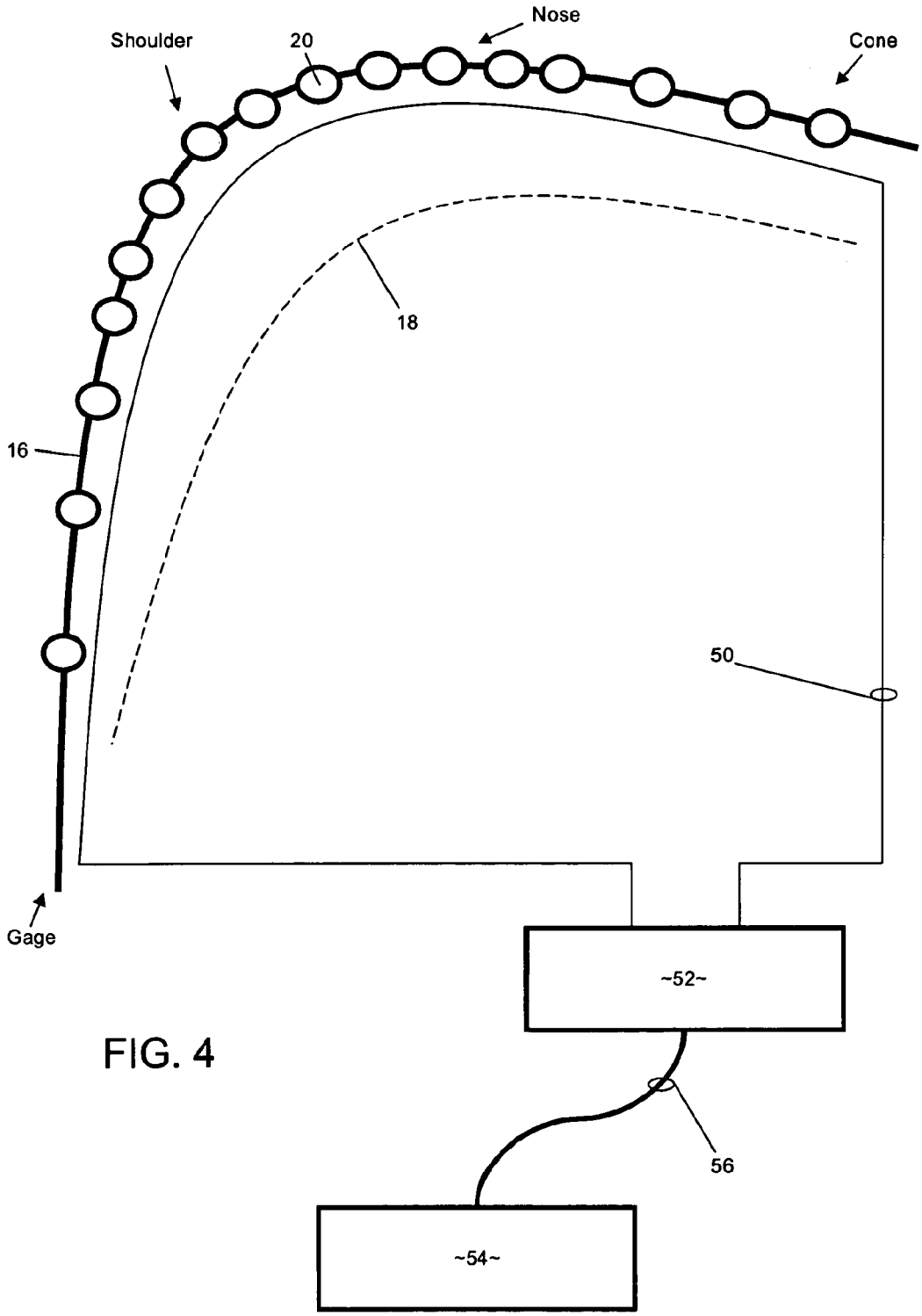
FIG. 4 is a partial cut-away elevation view of a blade of a drill bit a first embodiment of the present inventions.

As shown in FIG. 4, and discussed above, the cone section of each blade is preferably a substantially linear section extending from near a center-line of the drill bit 10 outward. Because the cone section is nearest the center-line of the drill bit 10, the cone section does not experience as much, or as fast, movement relative to the earth formation. Therefore, it has been discovered that the cone section commonly experiences less wear than the other sections. Thus, the cone section can maintain effective and efficient rate of penetration with less cutting material. This can be accomplished in a number of ways. For example, the cone section may have fewer cutting structures 44 and/or cutters 20, smaller cutting structures 44 and/or cutters 20, and/or more spacing between cutting structures 44 and/or cutters 20. The cone angle for a PDC bit is typically 15-25°, although, in some embodiments, the cone section is essentially flat, with a substantially 0° cone angle.

The nose represents the lowest point on a drill bit. Therefore, the nose cutter is typically the leading most cutter. The nose section is roughly defined by a nose radius. A larger nose radius provides more area to place cutters in the nose section. The nose section begins where the cone section ends, where the curvature of the blade begins, and extends to the shoulder section. More specifically, the nose section extends where the blade profile substantially matches a circle formed by the nose radius. The nose section experiences much more, and more rapid, relative movement than does the cone section. Additionally, the nose section typically takes more weight than the other sections. As such, the nose section commonly experiences much more wear than does the cone section. Therefore, the nose section preferably has a higher distribution, concentration, or density of cutting structures 44 and/or cutters 20.

The shoulder section begins where the blade profile departs from the nose radius and continues outwardly on each blade 18,38 to a point where a slope of the blade is essentially completely vertical, at the gage section. The shoulder section experiences much more, and more rapid, relative movement than does the cone section. Additionally, the shoulder section typically takes the brunt of abuse from dynamic dysfunction, such as bit whirl. As such, the shoulder section experiences much more wear than does the cone section. The shoulder section is also a more significant contributor to rate of penetration and drilling efficiency than the cone section. Therefore, the shoulder section preferably has a higher distribution, concentration, or density of cutting structures 44 and/or cutters 20. Depending on application, the nose section or the shoulder section may experience the most wear, and therefore either the nose section or the shoulder section may have the highest distribution, concentration, or density of cutting structures 44 and/or cutters 20.

The gage section begins where the shoulder section ends. More specifically, the gage section begins where the slope of the blade is predominantly vertical. The gage section continues outwardly to an outer perimeter or gauge of the drill bit 10. The gage section experiences the most, and most rapid, relative movement with respect to the earth formation. However, at least partially because of the high, substantially vertical, slope of the blade 18,38 in the gage section, the gage section does not typically experience as much wear as does the shoulder section and/or the nose section. The gage section does, however, typically experience more wear than the cone section. Therefore, the gage section preferably has a higher distribution of cutting structures 44 and/or cutters 20 than the cone section, but may have a lower distribution of cutting structures 44 and/or cutters 20 than the shoulder section and/or nose section.

As shown in FIG. 4, according to one embodiment of the present invention, a conductor or wire 50 is embedded within each blade 16. Each wire 50 is preferably pre-positioned in the mold during casting, or forming, of the bit 10. The wires 50 are preferably located within the blades 16, just below the cutters 20, well above the face 18 of the bit 10. In one embodiment, the wires 50 terminate in a electronic module 52, which may be connected to a surface computer 54 through a communications link 56, such as wire-line, measurement while drilling (MWD) and/or wireless communications. The computer 54 is preferably located at or near the surface of the well being drilled, or aboard the drilling rig, and is preferably monitored by a drilling operator or supervisor. Alternatively, the computer 54 may be located remotely from the well, such as at a central monitoring station.

The module 52 preferably monitors the wire 50, such as by continuously and/or periodically checking continuity of the wire 50. If the wire 50 breaks, such that continuity is lost for example, the module 52 notifies the surface computer 54 through the communications link 56. An operator at the surface is then notified that the bit 10 has experienced significant wear and needs to be replaced. This notification can be by any one or more of multiple means, such as an audible alarm, and/or visual indication. In some embodiments, which will be discussed in greater detail below, the operator is presented with a depiction of the bit 10 showing its real time condition, as determined by the module 52 using the wires 50. These advancements allow the operator to make better decisions, eliminating needless trips out of the hole, thereby greatly increasing drilling efficiency.

More specifically, as the bit 10 is used, the cutters 20 experience wear and eventually fail. The formation through which the bit 10 is drilling then begins to abrade the blades 16. As the blades 16 are abraded, the wire 50 is eventually exposed and abraded as well, thereby breaking a circuit formed by the wire 50 and the module 52. The module 52 senses this open circuit and notifies the surface computer 54 through the communications link 56. Thus, the operator can trip the bore hole assembly (BHA) or drill string to the surface and replace the bit 10 only when necessary while still avoiding a ring-out or other excessive wear condition.

Figure 5:
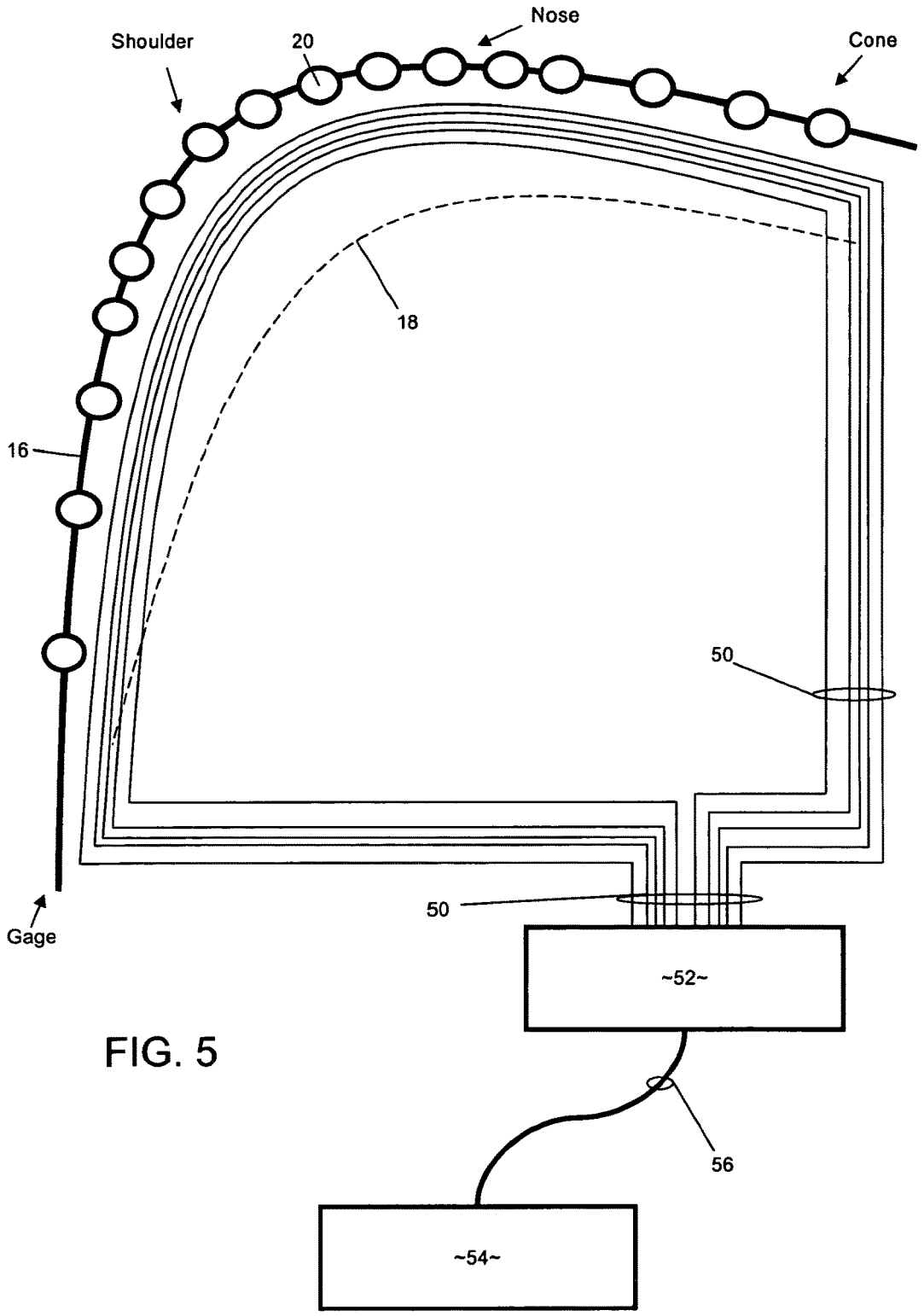
FIG. 5 is a partial cut-away elevation view of a blade of a drill bit a second embodiment of the present inventions.

As shown in FIG. 5, each blade 16 may have multiple wires 50 to better indicate wear. These wires 50 may be concentric, as shown, and/or may be arranged or routed in different or unique patterns to more thoroughly cover the interior of the blades 16. Concentric wires 50 may be used to better indicate the degree of wear. Differently routed wires 50 may be used to better indicate where wear is occurring. Each of the wires 50 may connect directly and independently to the module 52, as shown. Additionally, and/or alternatively, as will be discussed in more detail below, the wires 50 may share connections to the module 52.

Figure 6:
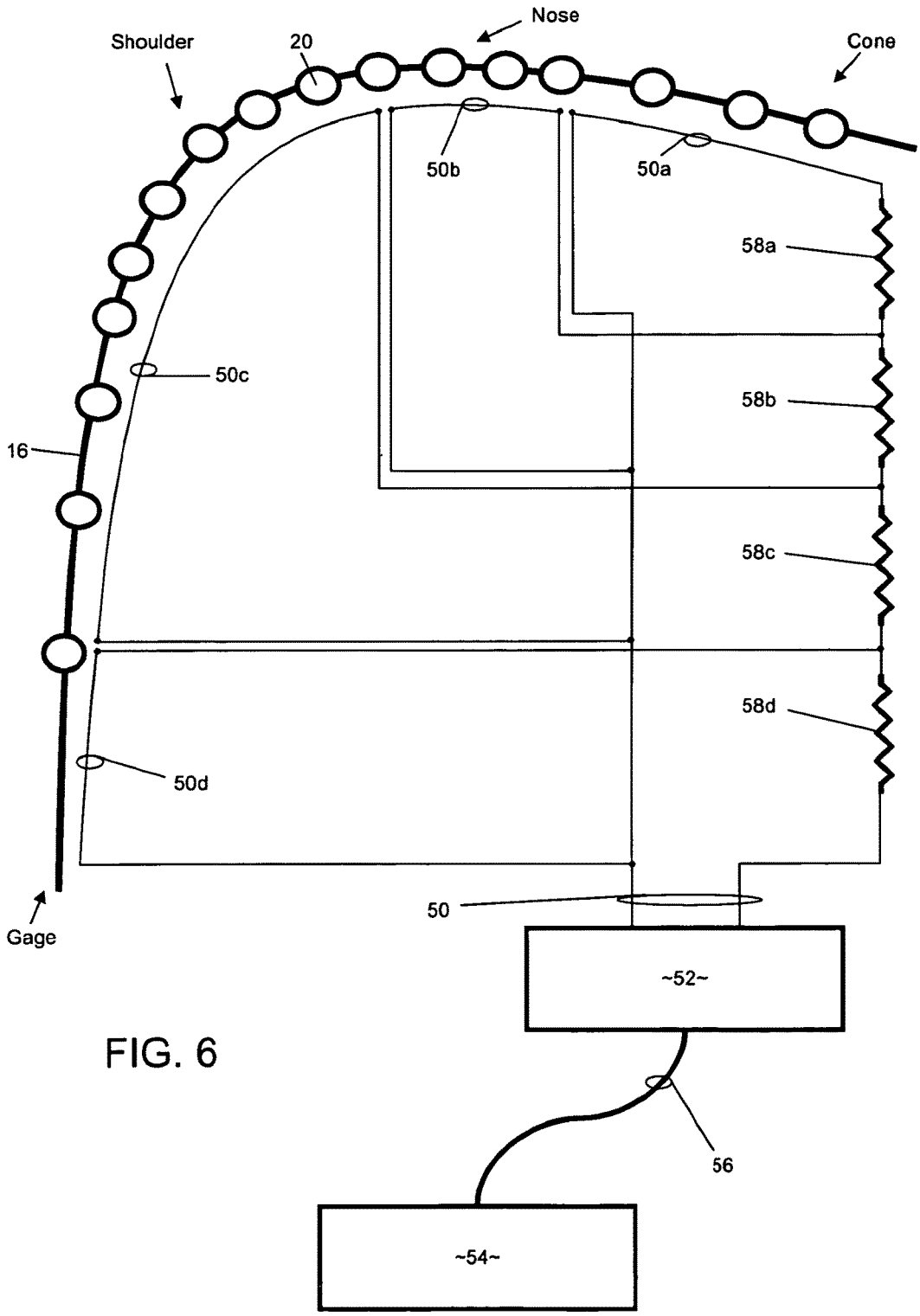
FIG. 6 is a partial cut-away elevation view of a blade of a drill bit a third embodiment of the present inventions.
Figure 7:
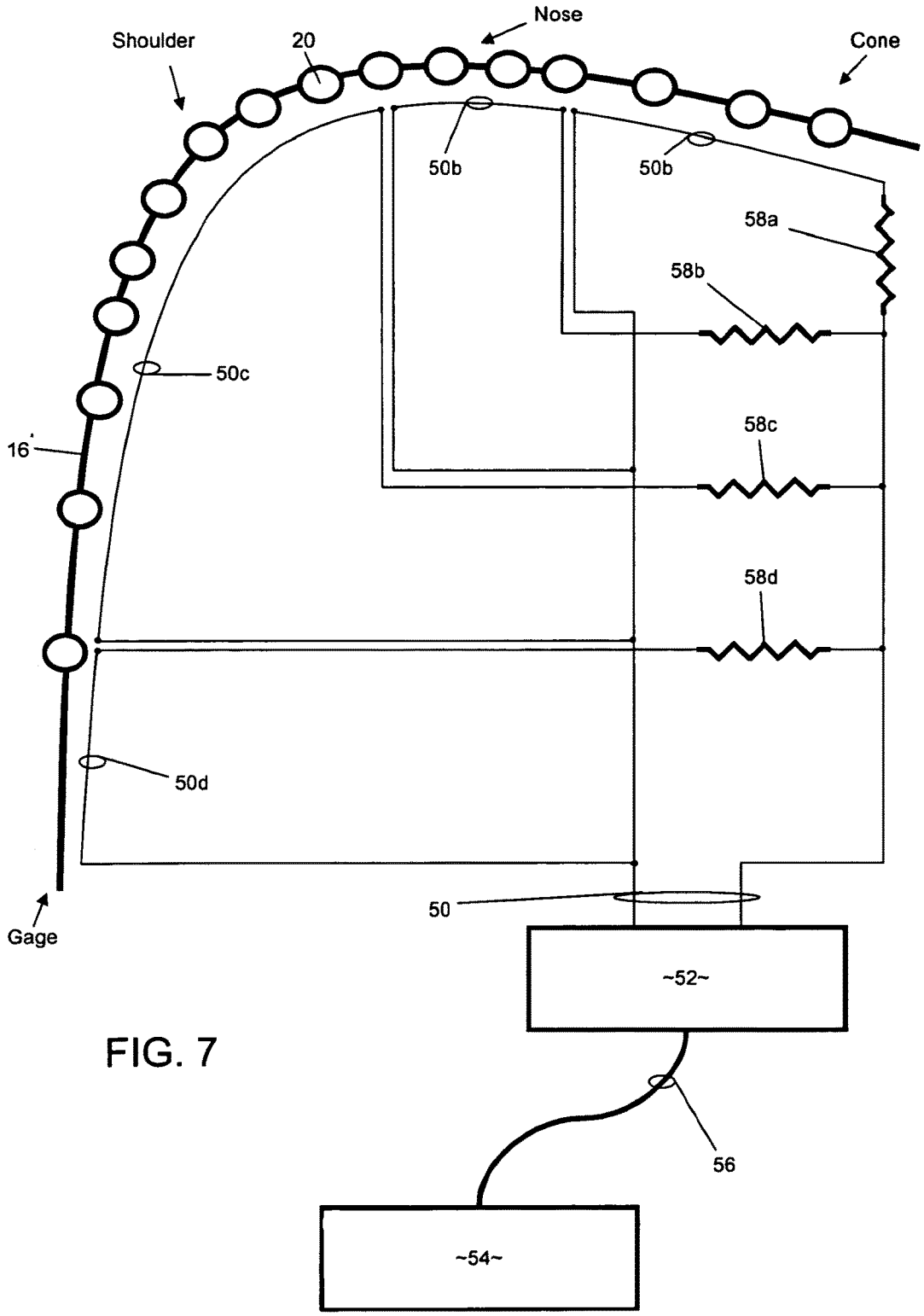
FIG. 7 is a partial cut-away elevation view of a blade of a drill bit a fourth embodiment of the present inventions.

As shown in FIG. 6 and FIG. 7, the wires 50 may comprise multiple individual loops 50*a*-50*d* in each blade 16. For example, the wires 50 may comprise a cone loop 50*a* embedded within the cone section of the blade 16. The wires 50 may comprise a nose loop 50*b* embedded within the nose section of the blade 16. The wires 50 may comprise a shoulder loop 50*c* embedded within the shoulder section of the blade 16. The wires 50 may comprise a gage loop 50*d* embedded within the gage section of the blade 16.

As discussed above, these loops 50*a*-50*d* may have direct and independent connections to the module 52. Additionally, and/or alternatively, the loops 50*a*-50*d* may share connections to the module 52, as shown. To allow the module 52 and/or the computer 54 to differentiate between them, the loops 50*a*-50*d* may include electrical and/or electronic components. For example, the loops 50*a*-50*d* may include resistive elements 58*a*-58*d*. Additionally, and/or alternatively, the loops 50*a*-50*d* may include capacitive and/or inductive elements. Furthermore, the loops 50*a*-50*d* may include electronic elements, such as microchips identifying each loop to the module 52 and/or computer 54.

More specifically, as shown in FIG. 7, each resistor 58*a*-58*d* is initially wired in parallel, resulting in an initial resistance. As one or more of the wires 50 are broken due to wear, the resistance seen by the module 52 increases. These changes in resistance can be detected by the module 52. Furthermore, by using resistors 58*a*-58*d* with different resistances, the module and/or computer 54 can determine which loops 50*a*-50*d* have been broken, thereby indicating which section of the bit 10 has experienced excessive wear, by comparing the initial resistance to the changed resistance using the known resistor values.

Of course, the modules 52 may be able to differentiate between the loops 50*a*-50*d* without discrete electrical and/or electronic components. For example, different lengths of resistive wire may be used as the loops themselves. The module 52 might detect and analyze the capacitance between the loops. The module 52 might detect and analyze inductive coupling between the loops.

Figure 8:
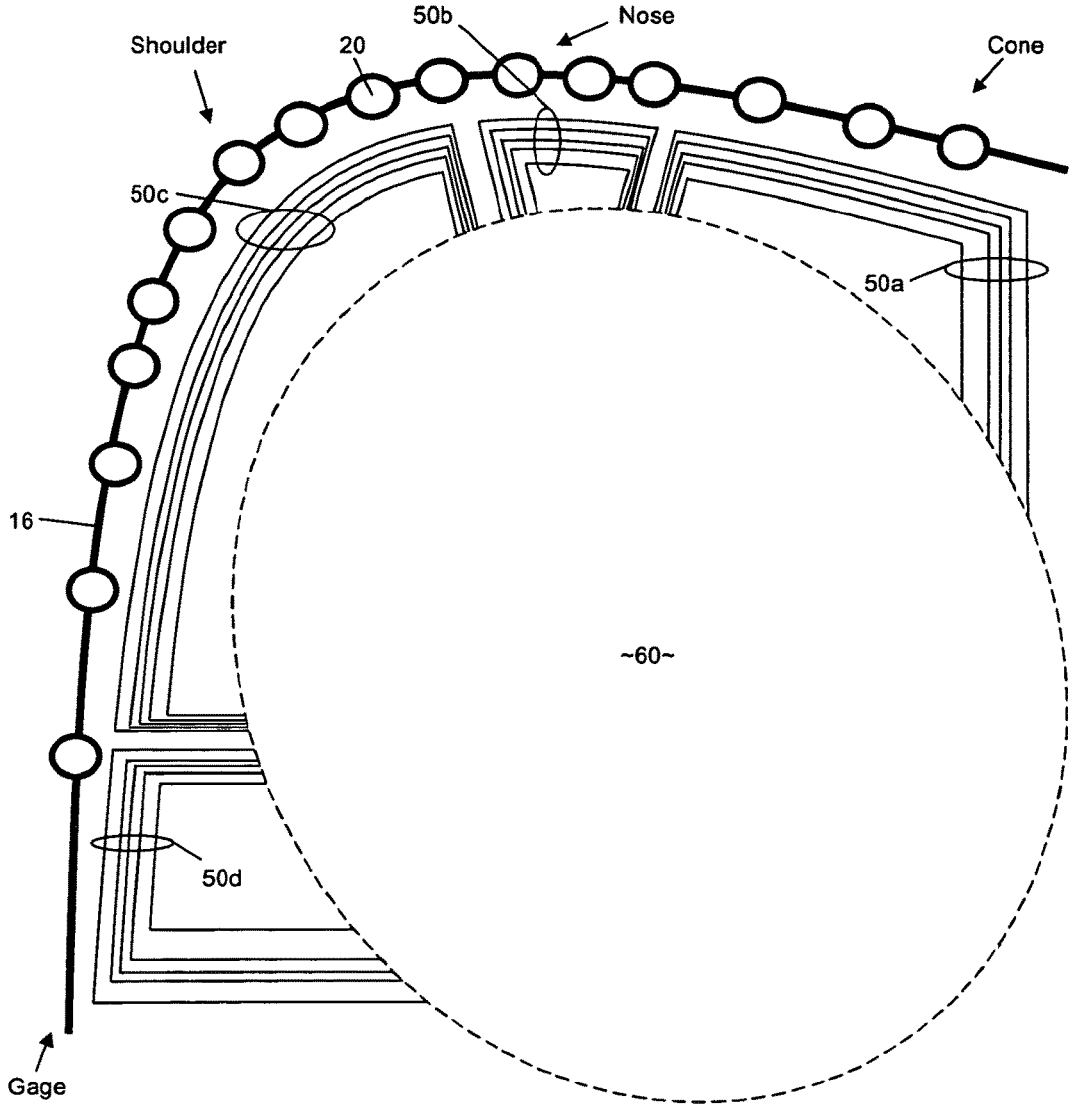
FIG. 8 is a partial cut-away elevation view of a blade of a drill bit a fifth embodiment of the present inventions.

As shown in FIG. 8, a combination of techniques may be utilized. For example, each section, may have multiple loops 50*a*-50*d*. These loops 50*a*-50*d* may be concentric and/or uniquely routed to better indicate the degree and/or exact location of the wear each section experiences. These loops 50*a*-50*d* may have direct and independent connections to the module 52 and/or may share connections to the module 52 utilizing electrical and/or electronic components to enable the module 52 to differentiate between them. For example, the loops from each section may share dedicated connections, such that the module 52 includes one set of connections for each section. The loops 50*a*-50*d*, electrical and/or electronic components, and/or module 52 may be collectively referred to a circuitry 60.

Figure 9:
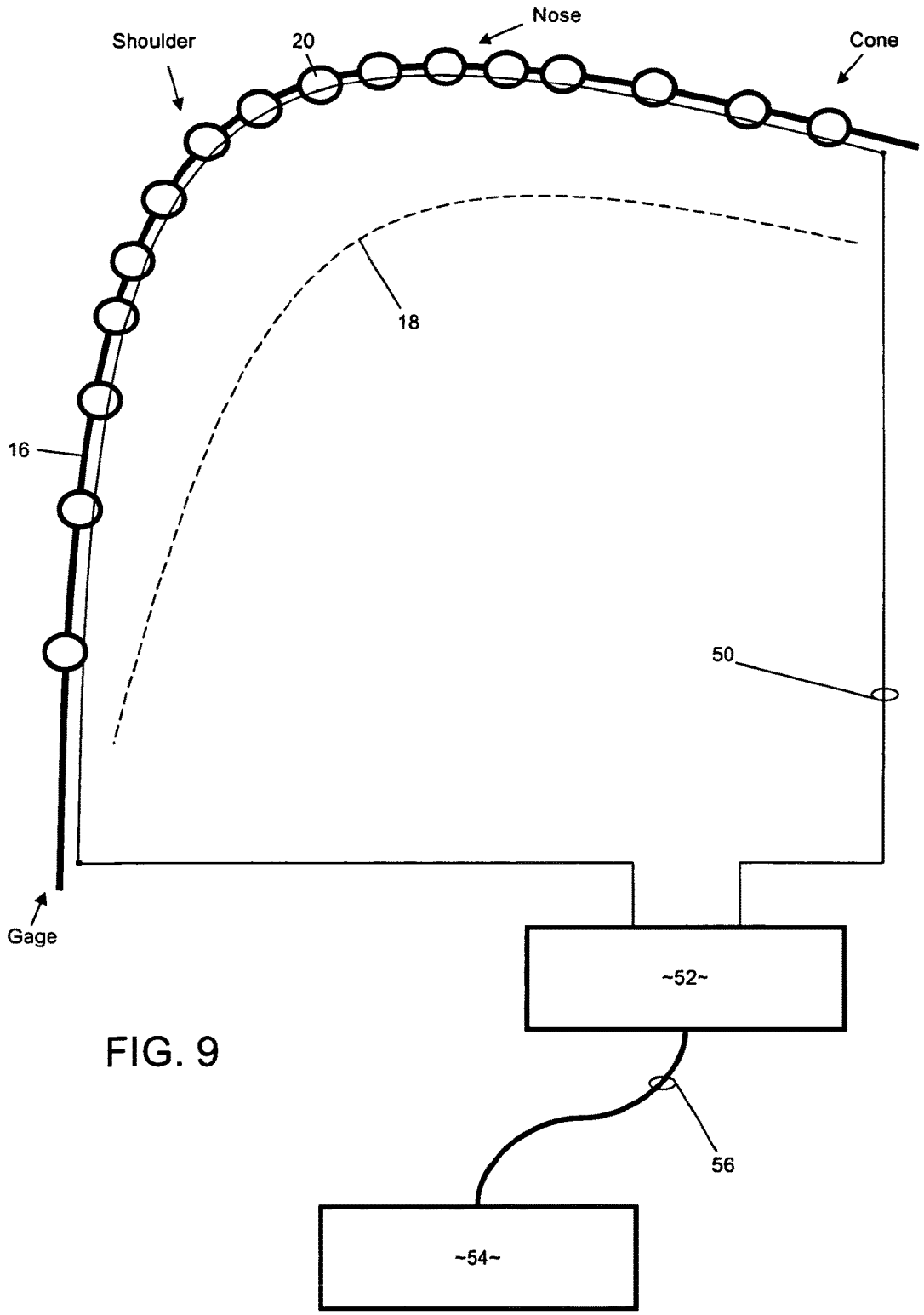
FIG. 9 is a partial cut-away elevation view of a blade of a drill bit a 6th embodiment of the present inventions.

While, in one embodiment, the conductors 50 are bare, routed through the non-conductive bit body 12, blades 16, and/or other components of the bit 10, the conductors 50 may be insulated. This may be helpful where several conductors are used in each blade 16 and/or may enable the use of blades 16 and/or a bit-body 12 made of conductive material, such as steel. One or more of the wires 50 may also be routed through the cutters 20 and/or cutting structures 44 themselves, as shown in FIG. 9. In this case, when the bit 10 looses one of the cutters 20, the module 52 would detect the open circuit and thereby indicate bit wear.

Figure 10:
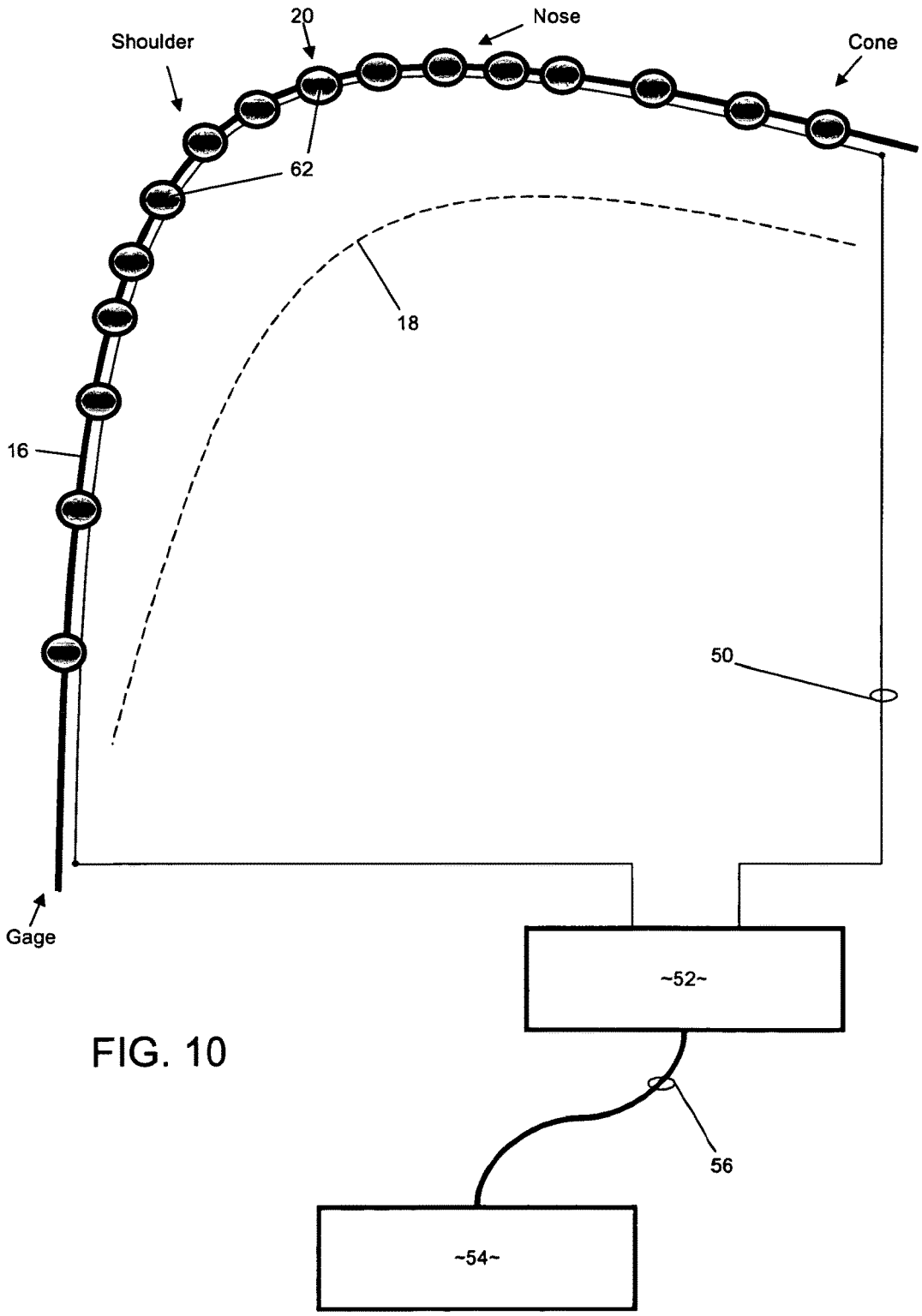
FIG. 10 is a partial cut-away elevation view of a blade of a drill bit a seventh embodiment of the present inventions.
Figure 11:
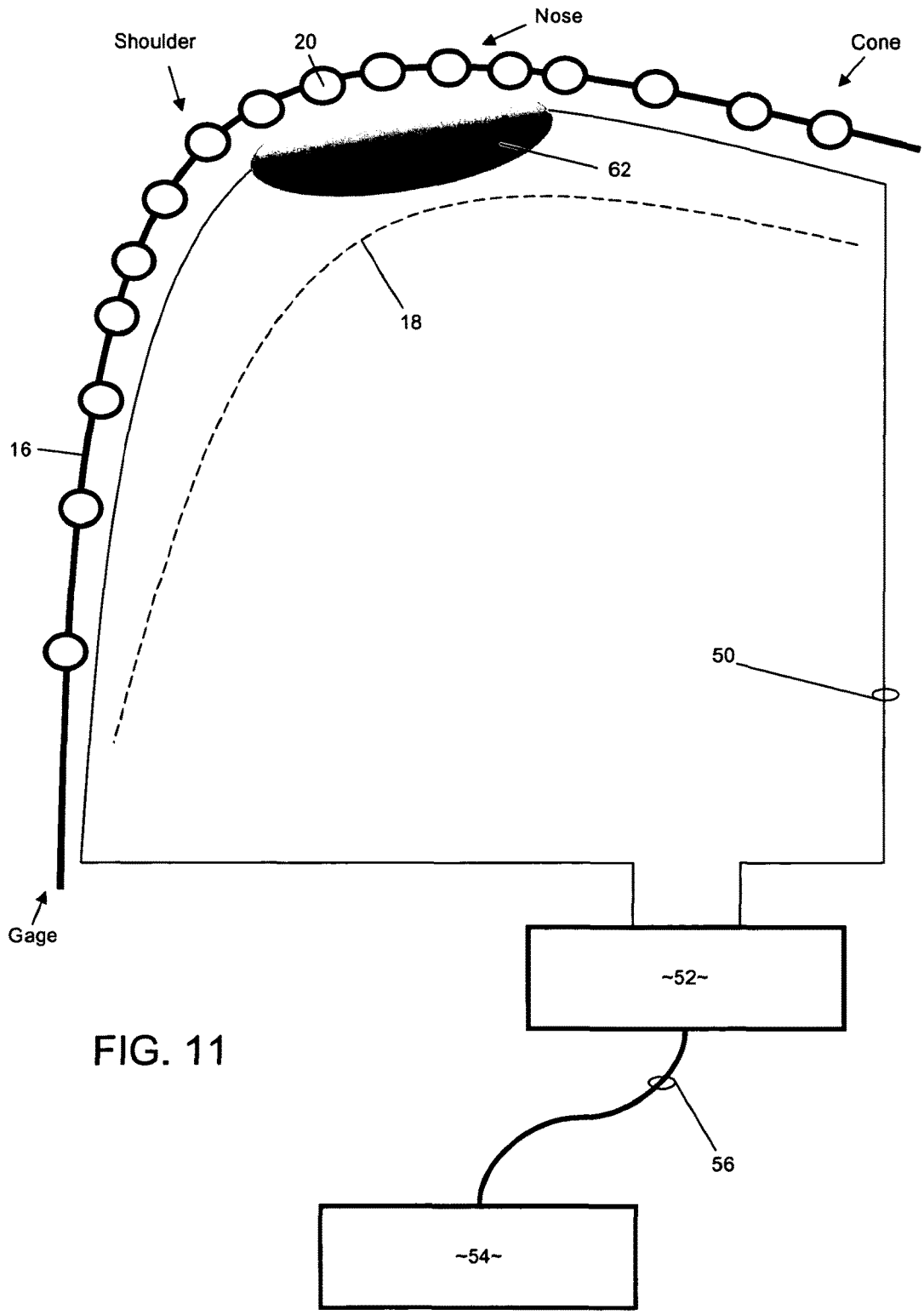
FIG. 11 is a partial cut-away elevation view of a blade of a drill bit a eight embodiment of the present inventions.

Alternatively, and/or additionally, any part of the circuitry described above may be provided by the bit body 12, blades 16, and/or other components of the bit 10 directly. For example, rather than simply running the wires 50 through the cutters 20, the cutters 20 and/or cutting structures 44 could form part of the conductivity path 50, as shown in FIG. 10. The cutters 20 may be doped with a witness material 62, such as boron, which would convert the diamond inserts into semiconductors. As the inserts wear, the conductivity detected by the circuitry 60 would change, resulting in signals to the computer 54 indicating wear of the bit 10. Alternatively, and/or additionally, the witness material 62 may be used anywhere within or through out the bit 10 and may be used to provide all or portions of the conductive paths 50, as shown in FIG. 11. As the witness material 62 is abraded, the characteristics of the circuitry 60 change, thereby indicating wear.

Rather than merely changing the conductivity of portions of the drill bit 10, the witness materials may additionally, or alternatively, change other characteristics of the bit 10. For example, the witness material may be used to indicate wear by altering a traditional bit's response to acoustic, optical, electrical, magnetic, and/or electromagnetic excitation. Such alternations would preferably change, in response to wear of the bit 10 or portion thereof.

Figure 12:
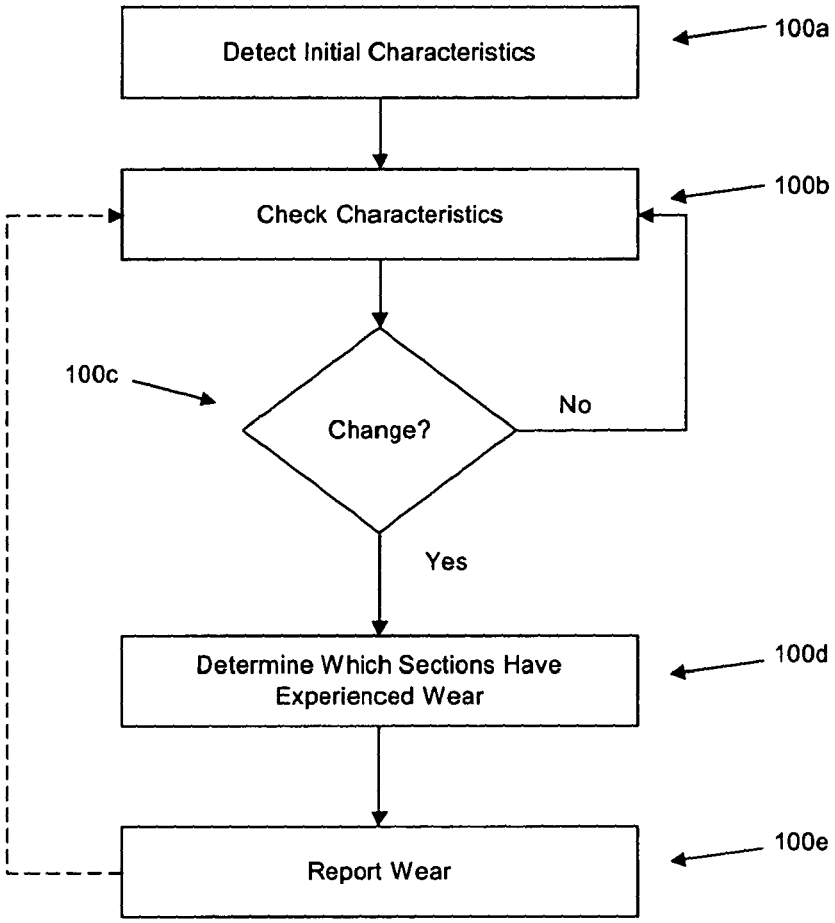
FIG. 12 is a flow chart illustrating certain aspects of the present inventions.

Referring also to FIG. 12, when the drill bit 10 is initially manufactured, paired with the module 52, and/or put into service, the module 52 detects the initial characteristic, such as conductivity, resistibility, or capacitance, as shown in step 100*a*. As the drill bit 10 is being used, the module 52 continuously or periodically checks that characteristic, as shown in step 100*b*. The module 52 compares the most recently detected characteristic to the initial characteristic, as shown in step 100*c*. As shown in step 100*d*, if there has been a change in the characteristic, the module 52 determines which section or sections have experienced wear, and how much wear.

For example, if 1000, 2000, 3000, and 4000 ohm resistors were used in the cone, nose, shoulder, and gage loops 50*a*-50*d*, respectively, then the initial resistance detected by the module 52 should be approximately 480 ohms. If the shoulder section were to experience wear abrading the shoulder loop 50*c*, the changed resistance checked by the module 52 should be approximately 571 ohms, indicating the loss of the 3000 ohm resistor caused by the open circuit in the shoulder loop 50*c*. Alternatively, if the nose section were to experience wear abrading the nose loop 50*b*, the changed resistance checked by the module 52 should be approximately 632 ohms, indicating the loss of the 2000 ohm resistor caused by the open circuit in the nose loop 50*b*. If the bit 10 experienced more significant wear, such as to both the nose and shoulder sections the changed resistance checked by the module 52 should be approximately 800 ohms, indicating the loss of the 2000 and 3000 ohm resistors caused by the open circuits in the nose and shoulder loops 50*b*,50*c*. In this manner, the module 52 can determine which section(s) have experienced wear and how much wear, as shown in step 100*d*.

Once the wear has been detected, by whatever method, it is reported, as shown in step 100*e*. The wear my be reported directly to an operator at the surface. For example, the operator may be shown a depiction of the bit 10. Wear may be indicated by discoloration of the portion of the bit 10 determined to have experienced wear. Alternatively, the portion of the bit 10 determined to have experienced wear may be removed from the display. How much is removed and/or discolored may depend on the degree of wear determined by the module 52. This display may be updated in substantially real-time, periodically, and/or on demand. The wear may also be reported to a control system, which may take warn the operator, log the wear report, and/or take corrective action automatically.

Figure 13:
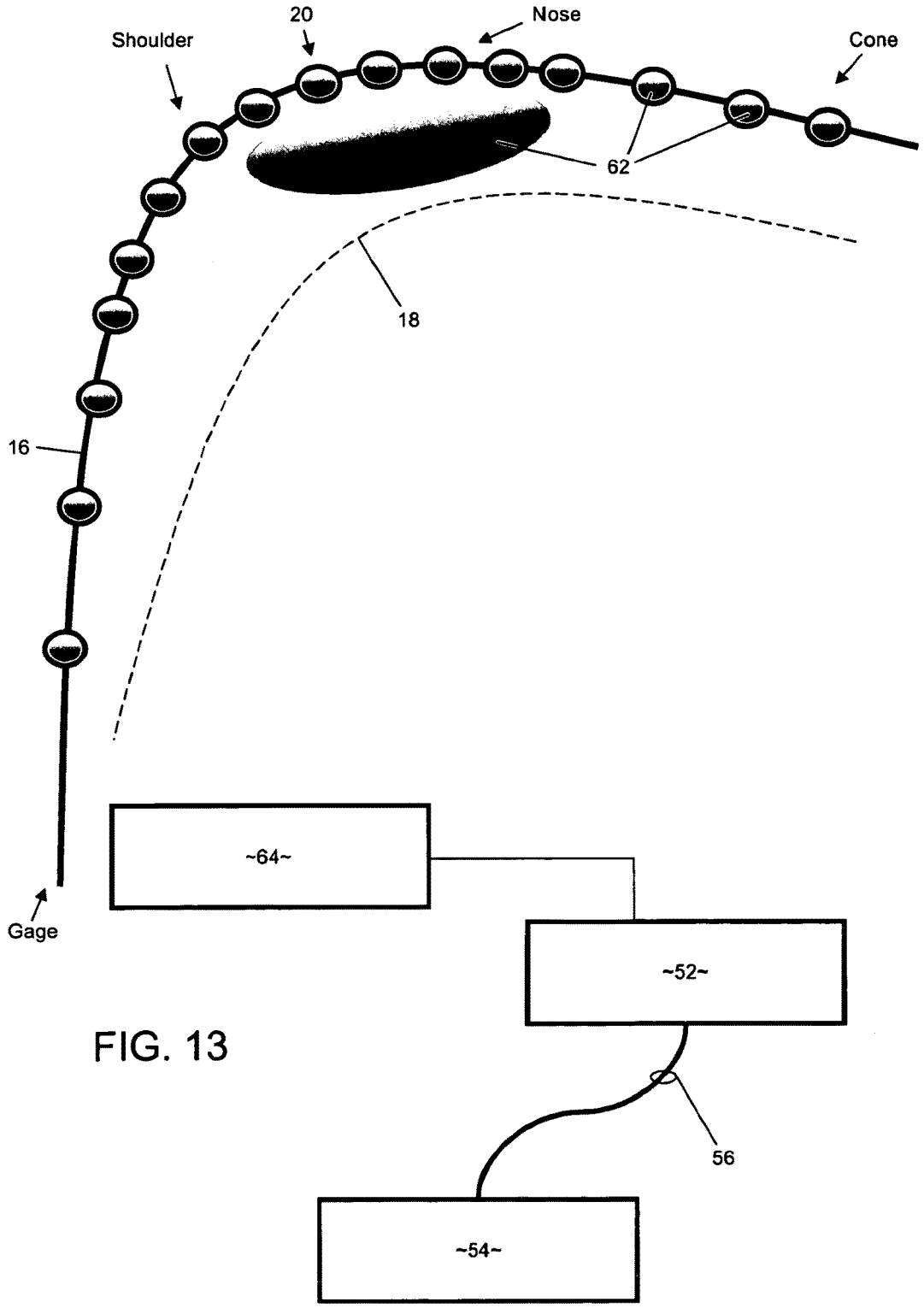
FIG. 13 is a partial cut-away elevation view of a blade of a drill bit a ninth embodiment of the present inventions.

Rather than monitoring the presence of the witness material 62 on the bit 10, bit body 12, blade 16, and/or cutter 20 or cutting structure 44, as discussed above, the module 52 and/or computer 54 could sense the witness material 62 after it has been separated from the bit 10. For example, as shown in FIG. 13, the witness material 62 may comprise an isotope, such as uranium or radium, initially embedded into the bit 10, bit body 12, one or more of the blades 16, and/or one or more of the cutters 20 or cutting structures 44. The module 52, and/or one or more sensors 64 in communication with the module 52, could be located, positioned, and/or configured to detect, or detect a change in an indication of, the witness material, after it has been separated from the bit 10.

More specifically, as shown in FIG. 14, the witness material 62 may be integrated into diamond based cutters 20 during isostatic pressing. In one embodiment, the witness material 62 is layered at substantially even spacing in the Z direction. In this embodiment, and possibly others, the witness material 62 may be an isotope, such as alpha particles or similar material with a suitably long half-life. The isotope may emit detectable signals continuously.

In an alternative embodiment, discusses above, the cutters 20 are doped with a material such as boron, phosphorous, gallium, or other material, thereby transforming portions of the cutters 20 themselves into witness materials 62. In one embodiment, the diamond cutting tables 28 may be transformed into semiconductors. More specifically, during actual drilling operations, heat is naturally generated, thereby activating the doping material and transforming the doped cutting tables 28 into semiconductors.

In any case, the cutters 20, according to certain aspects of the present invention, may exhibit a mesh-like structure comprising nodes of the isotope or doping material. The module 52 can determine wear using wired, wireless, acoustic, or other sensors to detect the presence or absence of the witness material 62. The wear can be displayed to an operator at the surface in real-time through, for example a modem, mud pulse telemetry, M-30 bus, or other transmission means. Alternatively, or additionally, the wear data may be stored in a memory of the module 52. The display may show an representation of actual wear of the bit 10 and/or cutters 20. For example, as shown in FIG. 15 and FIG. 16, if different isotopes are used in the different layers, the module 52 may be able to determine which portions of the cutters 20 have experienced the most wear, and display an actual three-dimensional representation of that wear.

It should be noted that only one blade 16 of a PDC bit is depicted in FIGS. 4-11 and 13. One should appreciate, upon reading this disclosure, that the above described circuitry may be implemented independently and/or dependently for each blade 16,38. One should also appreciate, upon reading this disclosure, that the above described circuitry could be implemented in an impregnated bit, as well as a hybrid bit. Furthermore, the above described circuitry could be implemented in a roller cone bit. Thus, the PDC bit depicted in FIGS. 4-11 and 13 is just one example of the possible applications. In this regard, the cutters 20, cutting structures 44, TSPs, and/or even diamond impregnated blades 38, etc. may be collectively referred to as cutting components.

The wires 50, components 58*a-d*, and/or witness material 62 may be introduced into the bit 10 after substantial manufacturing of the bit 10. Alternatively, the wires 50, components 58*a-d*, and/or witness material 62 are preferably formed during manufacturing of the bit 10. for example, the wires 50, components 58*a-d*, and/or witness material 62 may be pre-loaded into the mold during casting of the bit 10. In any case, the wires 50, components 58*a-d*, circuitry 60, and/or witness material 62 may be collectively referred to as a wear detector and/or components thereof.

Figure 17:
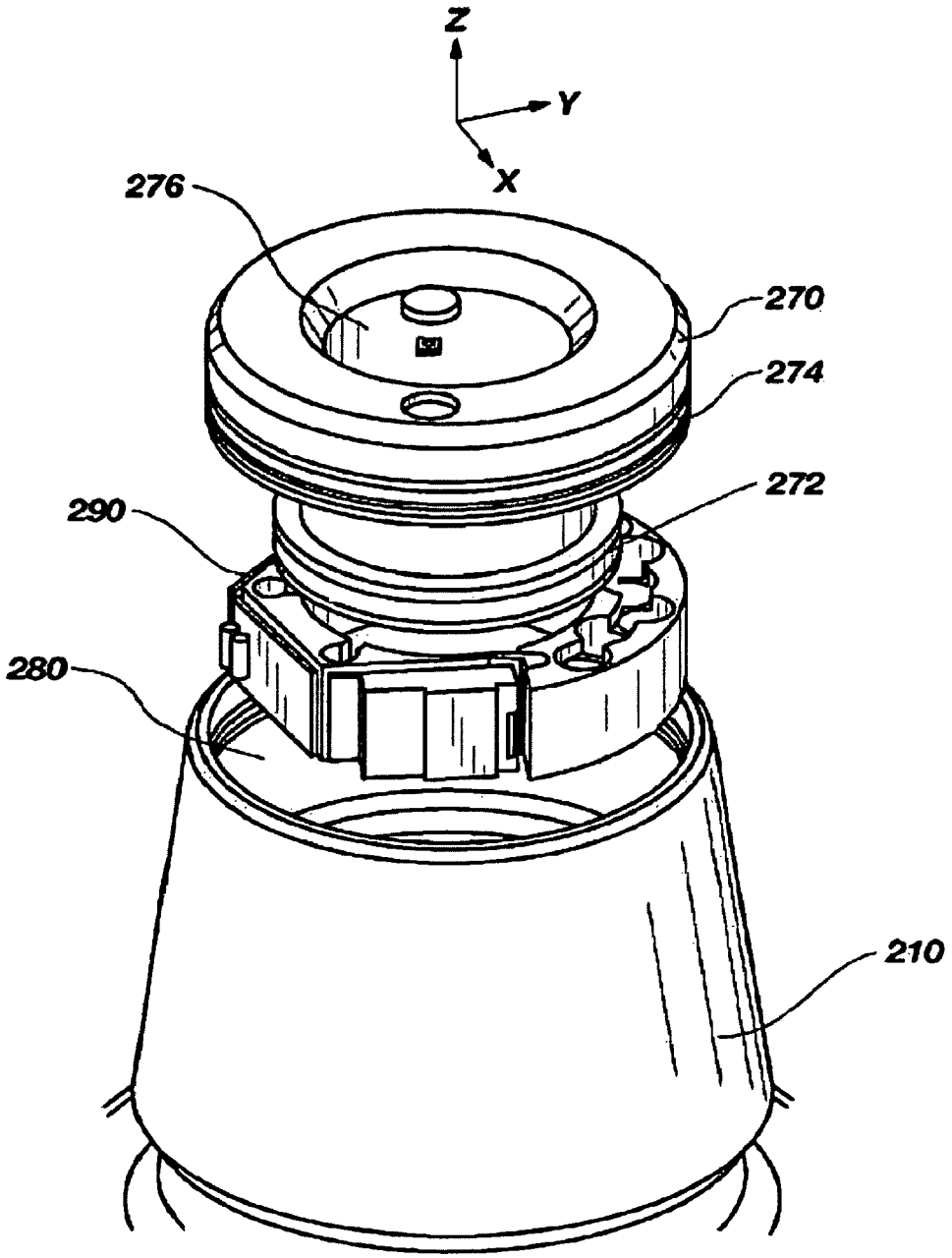
FIG. 17 illustrates a perspective view of a drill bit shank, an exemplary electronics module, and an end-cap that may form part of a bottomhole assembly utilizing certain aspects of the present inventions.

The module 52 may be similar to that described in U.S. Patent Application publication No. 20080060848, the disclosure of which is incorporated herein by reference. For example, FIG. 17 shows an exemplary embodiment of a shank 210 of a drill bit, such as the bit 10 discussed above, an end-cap 270, and an exemplary embodiment of an electronics module 290. The shank 210 includes a central bore 280 formed through the longitudinal axis of the shank 210. In conventional drill bits, this central bore 280 is configured for allowing drilling mud to flow therethrough. In the present invention, a portion of the central bore 280 is given a diameter sufficient for accepting the electronics module 290 configured in a substantially annular ring, yet without substantially affecting the structural integrity of the shank 210. Thus, the electronics module 290 may be placed down in the central bore 280, about the end-cap 270, which extends through the inside diameter of the annular ring of the electronics module 290 to create a fluid tight annular chamber with the wall of central bore 280 and seal the electronics module 290 in place within the shank 210.

The end-cap 270 includes a cap bore 276 formed therethrough, such that the drilling mud may flow through the end cap, through the central bore 280 of the shank 210 to the other side of the shank 210, and then into the body of drill bit. In addition, the end-cap 270 includes a first flange including a first sealing ring 272, near the lower end of the end-cap 270, and a second flange including a second sealing ring 274, near the upper end of the end-cap 270.

Figure 18:
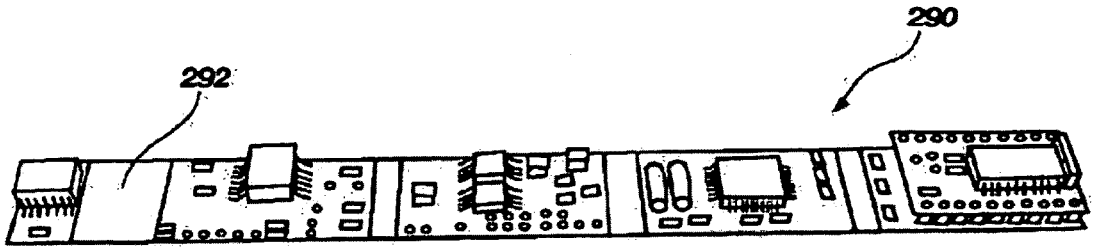
FIG. 18 illustrates a conceptual perspective view of an exemplary electronic module configured as a flex-circuit board enabling formation into an annular ring suitable for disposition in the shank of FIG. 17.

The electronics module 290 may be configured as a flex-circuit board, enabling the formation of the electronics module 290 into the annular ring suitable for disposition about the end-cap 270 and into the central bore 280. This flex-circuit board embodiment of the electronics module 290 is shown in a flat uncurled configuration in FIG. 18. The flex-circuit board 292 includes a high-strength reinforced backbone (not shown) to provide acceptable transmissibility of acceleration effects to sensors such as accelerometers. In addition, other areas of the flex-circuit board 292 bearing non-sensor electronic components may be attached to the end-cap 270 in a manner suitable for at least partially attenuating the acceleration effects experienced by the drill bit 10 during drilling operations using a material such as a visco-elastic adhesive.

The electronics module 290 may be configured to perform a variety of functions. One exemplary electronics module 290 may be configured as a data analysis module, which is configured for sampling data in different sampling modes, sampling data at different sampling frequencies, and analyzing data.

Figure 19:
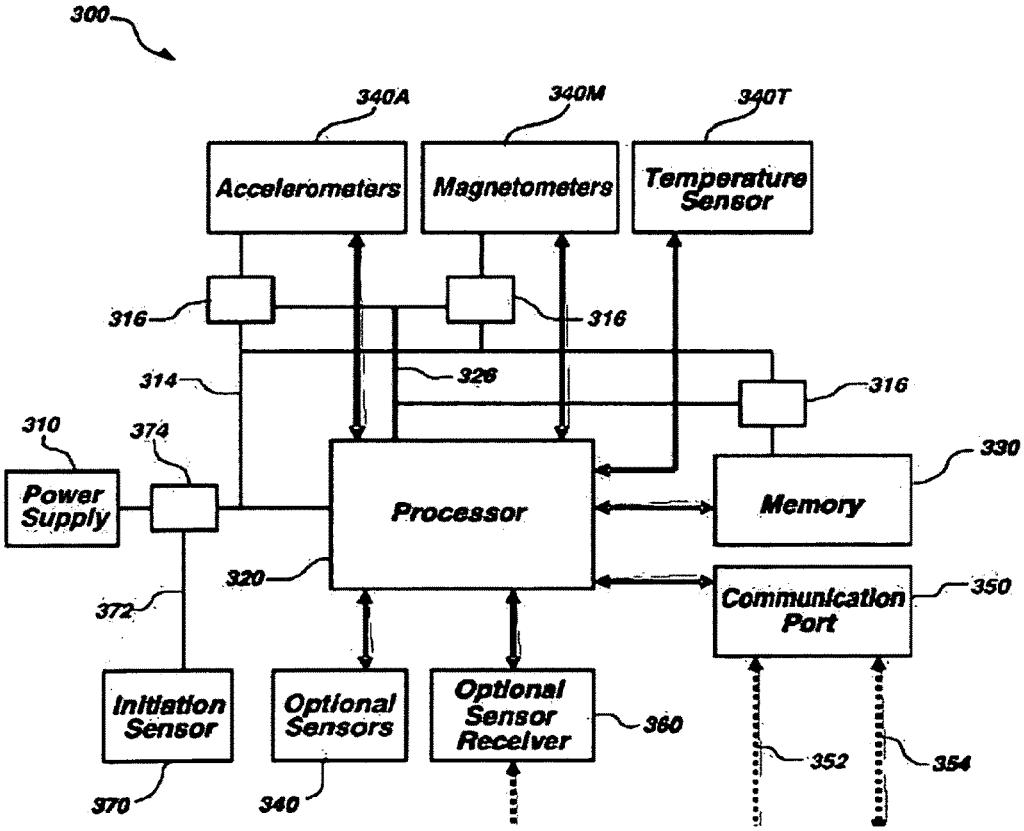
FIG. 19 illustrates a block diagram of an exemplary embodiment of a data analysis module utilizing certain aspects of the present invention.

An exemplary data analysis module 300 is illustrated in FIG. 19. The data analysis module 300 includes a power supply 310, a processor 320, a memory 330, and at least one sensor 340 configured for measuring a plurality of physical parameter related to a drill bit state, which may include drill bit condition, drilling operation conditions, and environmental conditions proximate the drill bit. In the exemplary embodiment of FIG. 19, the sensors 340 may include a plurality of accelerometers 340A, a plurality of magnetometers 340M, and at least one temperature sensor 340T.

The plurality of accelerometers 340A may include three accelerometers 340A configured in a Cartesian coordinate arrangement. Similarly, the plurality of magnetometers 340M may include three magnetometers 340M configured in a Cartesian coordinate arrangement. While any coordinate system may be defined within the scope of the present invention, an exemplary Cartesian coordinate system, shown in FIG. 17, defines a z-axis along the longitudinal axis about which the drill bit rotates, an x-axis perpendicular to the z-axis, and a y-axis perpendicular to both the z-axis and the x-axis, to form the three orthogonal axes of a typical Cartesian coordinate system. Because the data analysis module 300 may be used while the drill bit is rotating and with the drill bit in other than vertical orientations, the coordinate system may be considered a rotating Cartesian coordinate system with a varying orientation relative to the fixed surface location of the drilling rig.

The accelerometers 340A of the FIG. 19 embodiment, when enabled and sampled, provide a measure of acceleration, and thus vibration, of the drill bit along at least one of the three orthogonal axes. The data analysis module 300 may include additional accelerometers 340A to provide a redundant system, wherein various accelerometers 340A may be selected, or deselected, in response to fault diagnostics performed by the processor 320.

The magnetometers 340M of the FIG. 19 embodiment, when enabled and sampled, provide a measure of the orientation of the drill bit along at least one of the three orthogonal axes relative to the earth's magnetic field. The data analysis module 300 may include additional magnetometers 340M to provide a redundant system, wherein various magnetometers 340M may be selected, or deselected, in response to fault diagnostics performed by the processor 320.

The temperature sensor 340T may be used to gather data relating to the temperature of the drill bit, and the temperature near the accelerometers 340A, magnetometers 340M, and other sensors 340. Temperature data may be useful for calibrating the accelerometers 340A and magnetometers 340M to be more accurate at a variety of temperatures.

Other optional sensors 340 may be included as part of the data analysis module 300. Some exemplary sensors that may be useful in the present invention are strain sensors at various locations of the drill bit, temperature sensors at various locations of the drill bit, mud (drilling fluid) pressure sensors to measure mud pressure internal to the drill bit, and borehole pressure sensors to measure hydrostatic pressure external to the drill bit. These optional sensors 340 may include sensors 340 that are integrated with and configured as part of the data analysis module 300. These sensors 340 may also include optional remote sensors 340 placed in other areas of the drill bit 10, or above the drill bit in the BHA. The optional sensors 340 may communicate using a direct-wired connection, or through an optional sensor receiver 360. The sensor receiver 360 is configured to enable wireless remote sensor communication across limited distances in a drilling environment as are known by those of ordinary skill in the art.

One or more of these optional sensors may be used as an initiation sensor 370. The initiation sensor 370 may be configured for detecting at least one initiation parameter, such as, for example, turbidity of the mud, and generating a power enable signal 372 responsive to the at least one initiation parameter. A power gating module 374 coupled between the power supply 310, and the data analysis module 300 may be used to control the application of power to the data analysis module 300 when the power enable signal 372 is asserted. The initiation sensor 370 may have its own independent power source, such as a small battery, for powering the initiation sensor 370 during times when the data analysis module 300 is not powered. As with the other optional sensors 340, some exemplary parameter sensors that may be used for enabling power to the data analysis module 300 are sensors configured to sample; strain at various locations of the drill bit, temperature at various locations of the drill bit, vibration, acceleration, centripetal acceleration, fluid pressure internal to the drill bit, fluid pressure external to the drill bit, fluid flow in the drill bit, fluid impedance, and fluid turbidity. In addition, at least some of these sensors may be configured to generate any required power for operation such that the independent power source is self-generated in the sensor. By way of example, and not limitation, a vibration sensor may generate sufficient power to sense the vibration and transmit the power enable signal 372 simply from the mechanical vibration.

The memory 330 may be used for storing sensor data, signal processing results, long-term data storage, and computer instructions for execution by the processor 320. Portions of the memory 330 may be located external to the processor 320 and portions may be located within the processor 320. The memory 330 may be Dynamic Random Access Memory (DRAM), Static Random Access Memory (SRAM), Read Only Memory (ROM), Nonvolatile Random Access Memory (NVRAM), such as Flash memory, Electrically Erasable Programmable ROM (EEPROM), or combinations thereof. In the FIG. 19 exemplary embodiment, the memory 330 is a combination of SRAM in the processor (not shown), Flash memory 330 in the processor 320, and external Flash memory 330. Flash memory may be desirable for low power operation and ability to retain information when no power is applied to the memory 330.

In one embodiment, the data analysis module 300 uses battery power as the operational power supply 310. Battery power enables operation without consideration of connection to another power source while in a drilling environment. However, with battery power, power conservation may become a significant consideration in the present invention. As a result, a low power processor 320 and low power memory 330 may enable longer battery life. Similarly, other power conservation techniques may be significant in the present invention.

Additionally, one or more power controllers 316 may be used for gating the application of power to the memory 330, the accelerometers 340A, the magnetometers 340M, and other components of the data analysis module 300. Using these power controllers 316, software running on the processor 320 may manage a power control bus 326 including control signals for individually enabling a voltage signal 314 to each component connected to the power control bus 326. While the voltage signal 314 is shown in FIG. 19 as a single signal, it will be understood by those of ordinary skill in the art that different components may require different voltages. Thus, the voltage signal 314 may be a bus including the voltages necessary for powering the different components. A communication port 350 may be included in the data analysis module 300 for communication to external devices such as the MWD communication system 146 and a remote processing system 390. The communication port 350 may be configured for a direct communication link 352 to the remote processing system 390 using a direct wire connection or a wireless communication protocol, such as, by way of example only, infrared, Bluetooth, and 802.11a/b/g protocols. The communication port 350 may also be configured for communication with the MWD communication system 146 in a bottom hole assembly via a wired or wireless communication link 354 and protocol configured to enable remote communication across limited distances in a drilling environment as are known by those of ordinary skill in the art.

The above described circuitry 60, or any portion thereof, may be located entirely on, within, and/or adjacent the bit 10. Alternatively, some portion, such as the module 52, may be located remotely from the bit 10 or even the BHA. For example, the module 52, and/or certain functionality of the module 52, may be combined with the computer 54 at or near the surface. This may not be a preferred embodiment, in some applications, because of the exposure of the wires 50 that would result. However, armored cable and/or even a wireless communications link may be employed to control such risks.

In one embodiment, one or more of the resistive elements 58*a*-58*d* may provide temperature information as well. For example, one or more of the resistive elements 58*a*-58*d* may be resistive temperature devices (RTD), or other temperature sensitive resistive elements. Such RTDs 58*a*-58*d* could be dispersed about the bit 10, such as the blades 16, in any one or more of loops 50*a*-50*d*. Such an embodiment would provide resistive, continuity, and/or temperature information from locations dispersed about the bit 10. As discussed above, the electronics module 290 and/or data analysis module 300 may monitor the elements 58*a*-58*d*, as well as the other sensors. In doing so, the electronics module 290 and/or data analysis module 300 is able to combine the resistive, continuity, and/or temperature information with information from the other sensors to determine whether detected changes in the bit 10 itself, or performance of the bit 10, are due to changes in the earth formation or problems with the bit 10.

For example, loss continuity by itself, would potentially indicate that at least a portion of the bit 10 has worn away in the vicinity of the portion of the circuit formed by the wires 50 indicating the loss continuity. A relatively abrupt change in resistivity may also indicate wear in the portion of the bit 10 the vicinity of the portion of the circuit formed by the wires 50 indicating the abrupt change in resistivity. Alternatively, a relatively gradual change in resistivity, especially a reduction in resistivity, would instead likely indicate increased friction in that portion of the bit 10, which may be due to changes in the formation in the vicinity of the bit 10, and may indicate future excessive wear of the bit 10.

Other and further embodiments utilizing one or more aspects of the inventions described above can be devised without departing from the spirit of Applicant's invention. For example, the various methods and embodiments of the drill bit 10 can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A method of assembling a drill bit, such as for drilling into an earth formation, the method comprising the steps of:

forming the drill bit, including a bit body, a blade disposed on the bit body, and a plurality of cutting structures disposed on an exterior surface of the blade, at least a portion of the exterior surface having a curvature, doping a portion of the drill bit with a witness material that increases the conductivity of the drill bit;

embedding at least a portion of at least one electrical circuit into the blade, the electrical circuit including a conductor embedded in the blade proximate to the exterior surface, the conductor following a path in the blade that conforms to the curvature of at least the portion of the exterior surface and to the path followed by the plurality of cutting structures; and providing a module configured to monitor the at least one electrical circuit, the module further configured to generate an indication of bit wear and monitor characteristics of the earth formation, wherein the module is configured to generate the indication of the bit wear based on an amount of the witness material that is present in the drill bit.

2. The method as set forth in claim 1, further including providing a temperature sensor, and at least one accelerometer rigidly secured to the bit.

3. The method as set forth in claim 2, the module further configured to monitor the accelerometer and utilize information from both the temperature sensor and accelerometer in determining bit wear.

4. The method as set forth in claim 2, the module further configured to monitor the accelerometer and utilize information from both the temperature sensor and accelerometer in determining characteristics of the earth formation.

5. The method as set forth in claim 1, wherein the module determines wear by detecting an open circuit.

6. The method as set forth in claim 1, wherein a resistance of the circuit changes as at least one of: the bit wears and the earth formation adjacent the bit changes.

7. The method as set forth in claim 1, wherein the at least one electrical circuit includes individual loops, a portion of each loop having a shape that conforms to the curvature of a different section of the blade.

8. The method as set forth in claim 1, wherein the doping includes doping at least a portion of the blade that includes the path followed by the conductor.

9. The method as set forth in claim 1, wherein the doping includes doping at least one of a portion of the plurality of cutting structures and a portion of the blade with the witness material.

10. A drill bit assembly, such as for drilling into an earth formation, the assembly comprising:

a drill bit including a bit body, a blade disposed on the bit body, and a plurality of cutting structures disposed on an exterior surface of the blade, at least a portion of the exterior surface having a curvature, a portion of the drill bit doped with a witness material that increases the conductivity of the drill bit;

at least one electrical circuit including a conductor embedded in the blade proximate to the exterior surface, the conductor following a path in the blade that conforms to the curvature of at least the portion of the exterior surface and to the path followed by the plurality of cutting structures; and a module configured to monitor the electrical circuit and generate an indication of bit wear, wherein the module is configured to generate the indication of the bit wear based on an amount of the witness material that is present in drill bit.

11. The assembly as set forth in claim 10, wherein the module determines wear by at least one of: detecting an open circuit and detecting a change of resistance of the circuit as the earth formation adjacent the bit changes.

12. The assembly as set forth in claim 10, wherein the at least one electrical circuit includes individual loops, a portion of each loop having a shape that conforms to a curvature of a different section of the blade.

13. The assembly as set forth in claim 10, wherein the at least one electrical circuit is embedded within the bit during formation.

14. The assembly as set forth in claim 10, further including a temperature sensor, and at least one accelerometer rigidly secured to the bit.

15. The assembly as set forth in claim 14, the module being configured to monitor the accelerometer and utilize information from both the temperature sensor and accelerometer to determine bit wear.

16. The assembly as set forth in claim 14, the module being configured to monitor the accelerometer and utilize information from both the temperature sensor and accelerometer to determine characteristics of the earth formation.

* * * * *